US010679534B2

(12) United States Patent
Ryu et al.

(10) Patent No.: US 10,679,534 B2
(45) Date of Patent: Jun. 9, 2020

(54) DISPLAY DRIVING DEVICE INCLUDING SOURCE DRIVER AND TIMING CONTROLLER AND OPERATING METHOD FOR CONTROLLING SOURCE LINE SLEW TIMES

(71) Applicant: Samsung Electronics Co., Ltd., Suwon-si, Gyeonggi-do (KR)

(72) Inventors: KeunHo Ryu, Osan-si (KR); Byungkoan Kim, Hwaseong-si (KR); Jong-Hee Na, Hwaseong-si (KR); Yong-Yun Park, Seoul (KR); Seunghwan Baek, Hwaseong-si (KR); MyeongJun Chae, Seoul (KR); YoungMin Choi, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 100 days.

(21) Appl. No.: 15/868,322

(22) Filed: Jan. 11, 2018

(65) Prior Publication Data

US 2018/0357946 A1 Dec. 13, 2018

(30) Foreign Application Priority Data

Jun. 9, 2017 (KR) ..... 10-2017-0072692

(51) Int. Cl.
*G09G 3/20* (2006.01)
*G09G 3/00* (2006.01)

(52) U.S. Cl.
CPC ..... *G09G 3/006* (2013.01); *G09G 3/2092* (2013.01); *G09G 2310/027* (2013.01); *G09G 2310/0297* (2013.01); *G09G 2310/066* (2013.01); *G09G 2310/08* (2013.01); *G09G 2320/0223* (2013.01); *G09G 2320/0233* (2013.01); *G09G 2320/045* (2013.01); *G09G 2330/028* (2013.01); *G09G 2330/12* (2013.01)

(58) Field of Classification Search
CPC ..... G09G 3/2092; G09G 3/006; G09G 2320/0223; G09G 2320/0233; G09G 2320/045; G09G 2310/08; G09G 2310/027; G09G 2310/066; G09G 2310/0297; G09G 2330/028; G09G 2330/12
See application file for complete search history.

(56) References Cited

U.S. PATENT DOCUMENTS 6,288,699 B1 * 9/2001 Kubota ..... G09G 3/3648 345/213
6,903,589 B2 6/2005 Kim
(Continued)

FOREIGN PATENT DOCUMENTS

JP 2012/175115 A 9/2012
KR 100506887 B1 8/2005
(Continued)

*Primary Examiner* — Darlene M Ritchie
(74) *Attorney, Agent, or Firm* — Harness, Dickey & Pierce, P.L.C.

(57) ABSTRACT

A display driving device is disclosed which includes a source driver that supplies voltages to source lines connected to pixels, detects a slew time of the voltages of the source lines, and outputs the slew time, and a timing controller that receives the slew time from the source driver and updates a way for the source driver to control the voltages depending on the slew time.

20 Claims, 17 Drawing Sheets

(56) References Cited

U.S. PATENT DOCUMENTS

| | | | | |
|---|---|---|---|---|
| 7,948,465 | B2 | 5/2011 | Cho et al. | |
| 8,054,280 | B2 | 11/2011 | Choi et al. | |
| 8,599,179 | B2 | 12/2013 | Kim et al. | |
| 8,717,349 | B2 | 5/2014 | Tsai et al. | |
| 9,514,684 | B2 | 12/2016 | Tsubakino et al. | |
| 9,519,015 | B2 | 12/2016 | Chung-Chieh et al. | |
| 10,217,431 | B2 * | 2/2019 | Kim | G09G 3/3674 |
| 2003/0098833 | A1 * | 5/2003 | Sekido | G09G 3/3688 345/87 |
| 2003/0160753 | A1 * | 8/2003 | McCartney | G09G 3/3611 345/99 |
| 2004/0061675 | A1 * | 4/2004 | Hirakawa | G09G 5/008 345/88 |
| 2004/0239610 | A1 * | 12/2004 | Ishii | G09G 3/3611 345/100 |
| 2004/0252093 | A1 * | 12/2004 | Park | G09G 3/3688 345/94 |
| 2007/0120780 | A1 * | 5/2007 | Park | G09G 3/3291 345/76 |
| 2008/0136756 | A1 * | 6/2008 | Yeo | G09G 3/3677 345/87 |
| 2008/0246752 | A1 | 10/2008 | Lee | |
| 2010/0066726 | A1 * | 3/2010 | Kim | G09G 3/3648 345/214 |
| 2010/0110058 | A1 * | 5/2010 | Moh | G09G 3/3655 345/211 |
| 2011/0148954 | A1 * | 6/2011 | Tobita | G09G 3/3688 345/698 |
| 2015/0185812 | A1 * | 7/2015 | Hyun | G06F 1/3225 711/105 |
| 2015/0279297 | A1 * | 10/2015 | Nakano | G06F 3/041 345/173 |
| 2015/0302816 | A1 * | 10/2015 | Won | G09G 3/3685 345/87 |
| 2016/0118006 | A1 * | 4/2016 | Park | G09G 3/3666 345/690 |
| 2016/0275897 | A1 | 9/2016 | Lin et al. | |
| 2016/0284297 | A1 * | 9/2016 | Cheng | G09G 3/3648 |
| 2017/0004799 | A1 | 1/2017 | Park et al. | |
| 2017/0047001 | A1 | 2/2017 | Shin et al. | |
| 2017/0309210 | A1 * | 10/2017 | Chaji | G09G 1/002 |
| 2018/0047339 | A1 * | 2/2018 | Morita | G09G 3/3283 |
| 2018/0286305 | A1 * | 10/2018 | Kim | G09G 3/30 |

FOREIGN PATENT DOCUMENTS

| | | |
|---|---|---|
| KR | 2016/0029995 A | 3/2016 |
| KR | 2017/0005291 A | 1/2017 |

* cited by examiner

DISPLAY DRIVING DEVICE INCLUDING SOURCE DRIVER AND TIMING CONTROLLER AND OPERATING METHOD FOR CONTROLLING SOURCE LINE SLEW TIMES

CROSS-REFERENCE TO RELATED APPLICATIONS

This U.S. non-provisional application claims the benefit of priority under 35 U.S.C. § 119 to Korean Patent Application No. 10-2017-0072692, filed on Jun. 9, 2017, in the Korean Intellectual Property Office (KIPO), the entire contents of which are hereby incorporated by reference.

BACKGROUND

Various example embodiments of the inventive concepts described herein relate to an electronic device, and more particularly, to a display driving device including a source driver and a timing controller, and an operating method of the display driving device.

A display device displays image data that is to be perceived by a user. For example, the display device may include pixels displaying different colors and may display an image by adjusting the brightness of each pixel. The display device may select a row of pixels, the brightness of which will be adjusted, by using gate lines, and may adjust the brightness of each pixel of the selected row by using source lines.

To display an image, the display device includes gate drivers to control the gate lines and source drivers to control the source lines. Charging rates of the source drivers may vary as the size of the display device increases and as various technologies for reducing manufacturing costs of the display device are applied. If the charging rates of the source drivers vary, block dim (e.g., the dimming of a block or collection of pixels) may occur in the display device, thereby reducing the quality of images that the electronic device displays.

SUMMARY

Various example embodiments of the inventive concepts provide a display driving device that reduces and/or prevents an image quality from being reduced, lowered, and/or deteriorated due to differences between charging rates and an operating method of the display driving device.

According to an aspect of at least one example embodiment, a display driving device includes a source driver configured to supply voltages to a plurality of source lines connected to a pixel array, detect a slew time of the voltages of the source lines, and output the slew time, and a timing controller configured to receive the slew time from the source driver and to transmit update information for the source driver to control the voltages based on the slew time.

According to another aspect of at least one example embodiment, a display driving device includes a plurality of source drivers configured to supply voltages to a plurality of source lines connected to a pixel array and to output slew times of the voltages, and a timing controller configured to receive the slew times from the plurality of source drivers and to update the plurality of source drivers based on the slew times so that the plurality of source drivers uniformly control the voltages.

According to another aspect of at least one example embodiment, an operating method of a display driving device including a plurality of source drivers and a timing controller includes detecting slew times for the plurality of source drivers to control voltages of source lines depending on a request of the timing controller, and updating, by the timing controller, the plurality of source drivers based on the slew times so that the source drivers controls the voltages uniformly.

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Figure 1:
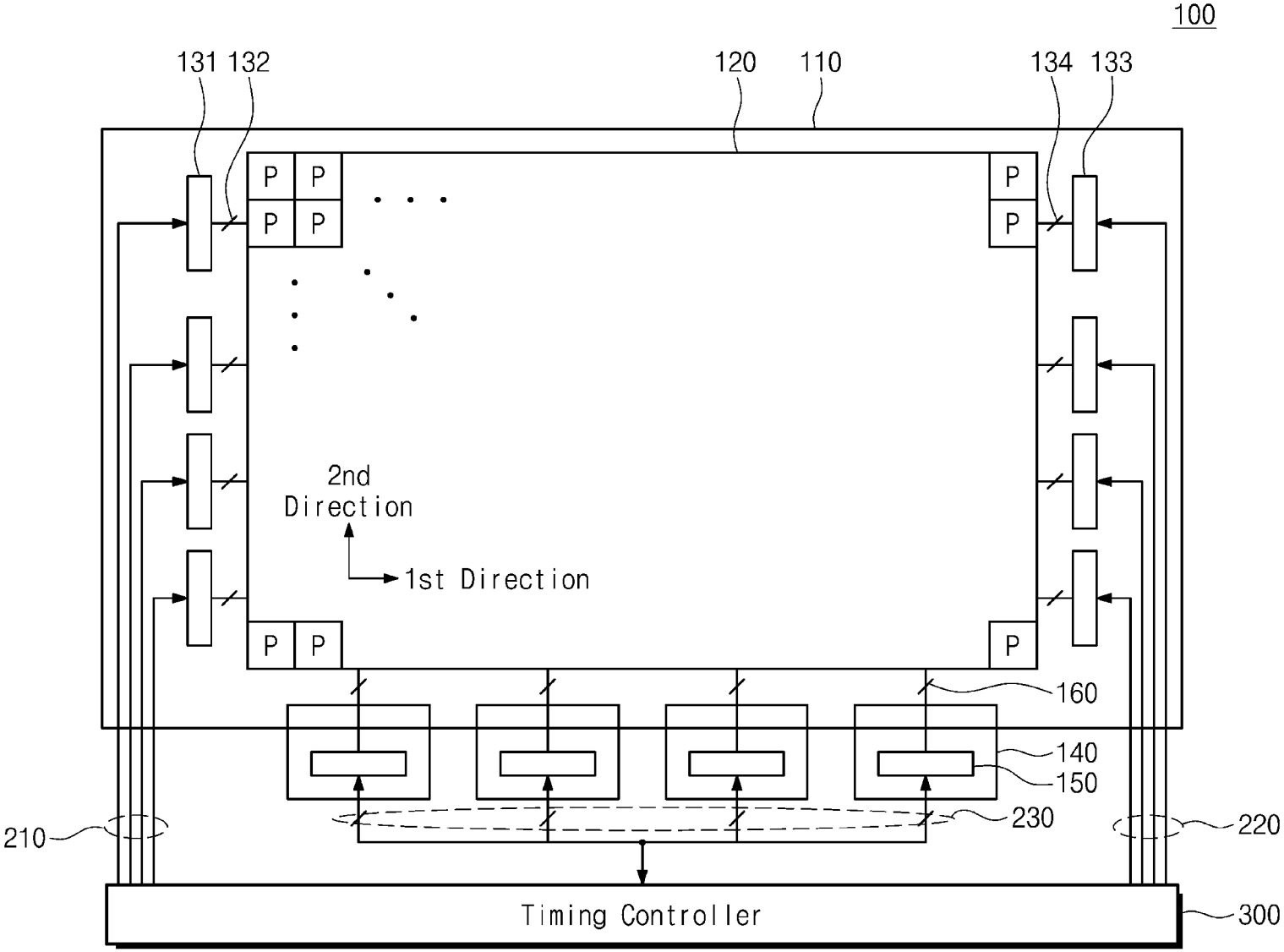
FIG. 1 is a block diagram illustrating a display device according to at least one example embodiment of the inventive concepts.

Various example embodiments will now be described more fully with reference to the accompanying drawings, in which some example embodiments are shown. Example embodiments, may, however, be embodied in many different forms and should not be construed as being limited to the embodiments set forth herein; rather, these example embodiments are provided so that this disclosure will be thorough and complete, and will fully convey the scope of example embodiments of inventive concepts to those of ordinary skill in the art. In the drawings, the thicknesses of layers and regions are exaggerated for clarity. Like reference characters and/or numerals in the drawings denote like elements, and thus their description may be omitted.

FIG. 1 is a block diagram illustrating a display device 100 according to at least one example embodiment of the inventive concepts. Referring to FIG. 1, the display device 100 includes a substrate 110, a display panel 120, first gate drivers 131, first gate lines 132, second gate drivers 133, second gate lines 134, films 140, source drivers 150, source lines 160, first lines 210, second lines 220, third lines 230, and a timing controller 300, but the example embodiments are not limited thereto.

Various elements constituting the display device 100 may be disposed on the substrate 110. The substrate 110 may include and/or may be formed from a transparent material through which light can pass through, such as glass. The display panel 120 may be formed on the substrate 110. The display panel 120 may include pixels P arranged along a first direction and a second direction (e.g., a pixel array). The pixels P may display various colors by using a combination of some colors, such as red (R), green (G) and blue (B), etc.

The first gate drivers 131 are connected to the pixels P through the first gate lines 132. Each of the first gate drivers 131 may be connected to two or more first gate lines. The second gate drivers 133 are connected to the pixels P through the second gate lines 134. Each of the second gate drivers 133 may be connected to two or more of the second gate lines 134. The one or more gate drivers, e.g., the first gate drivers 131 and the second gate drivers 133 may select a row of the pixels P, the colors of which will be changed.

The films 140 may be attached to the substrate 110. The one or more source drivers 150 may be disposed on the films 140. The source drivers 150 are connected to the pixels P through the source lines 160. Each of the source drivers 150 may be connected to two or more source lines. The source drivers 150 may control brightness of each pixel of the selected row of pixels of the pixel array by controlling voltages of the source lines 160.

The timing controller 300 is connected to the first gate drivers 131 through the first lines 210, to the second gate drivers 133 through the second lines 220, and the source drivers 150 through the third lines 230. The timing controller 300 may control the timing of when the first and second gate drivers 131 and 133 select each row of pixels P, through the first and second lines 210 and 220.

The timing controller 300 may control a way for the source drivers 150 to control voltages of the source lines 160 through the third lines 230 and may provide the source drivers 150 with information for controlling, at the source drivers 150, voltages of the source lines 160.

To improve the clarity of FIG. 1, connections between the films 140 and the timing controller 300 and connections between the first and second gate drivers 131 and 133 and the timing controller 300 are illustrated simply with arrows. The connections between the films 140 and the timing controller 300 and the connections between the first and second gate drivers 131 and 133 and the timing controller 300 are not limited to the illustration depicted in FIG. 1.

In at least one example embodiment, the timing controller 300 and the source drivers 150 may constitute a display driving device that drives the display panel 120. Additionally, the timing controller 300, the source drivers 150, and the first and second gate drivers 131 and 133 may constitute a display driving device to drive the display panel 120.

Various technologies such as a gate-on-array (GOA) technology, a dual gate technology, and a triple gate technology may be used to increase the resolution of the display panel 120 and to reduce manufacturing costs according to some example embodiments. As these technologies are used, a difference in the charging rates of the source drivers 150 may occur. Also, if a fault, error, and/or deficiency occurs when at least one of the films 140 is attached to the substrate 110, a charging rate of a source driver corresponding to the faulty film may differ from the charging rates of the remaining source drivers, etc.

Moreover, the resistance and capacitance of the source lines 160 increase as the display panel 120 becomes larger due to the additional length needed for the source lines 160. If the resistance and capacitance of the source lines 160 increases, the charging rates of the source lines 160 increases. If the charging rates increase, the differences between the charging rates of the source drivers 150 may be amplified more and more. Differences between the charging rates may cause a decrease in an image quality such as block dim in the display panel 120.

To reduce and/or prevent the above phenomenon, the timing controller 300 may update (and/or control) the source drivers 150 to compensate for the difference between charging rates. Below, a method in which the timing controller 300 controls the source drivers 150 to compensate for differences between charging rates will be described with reference to accompanying drawings.

Figure 2:
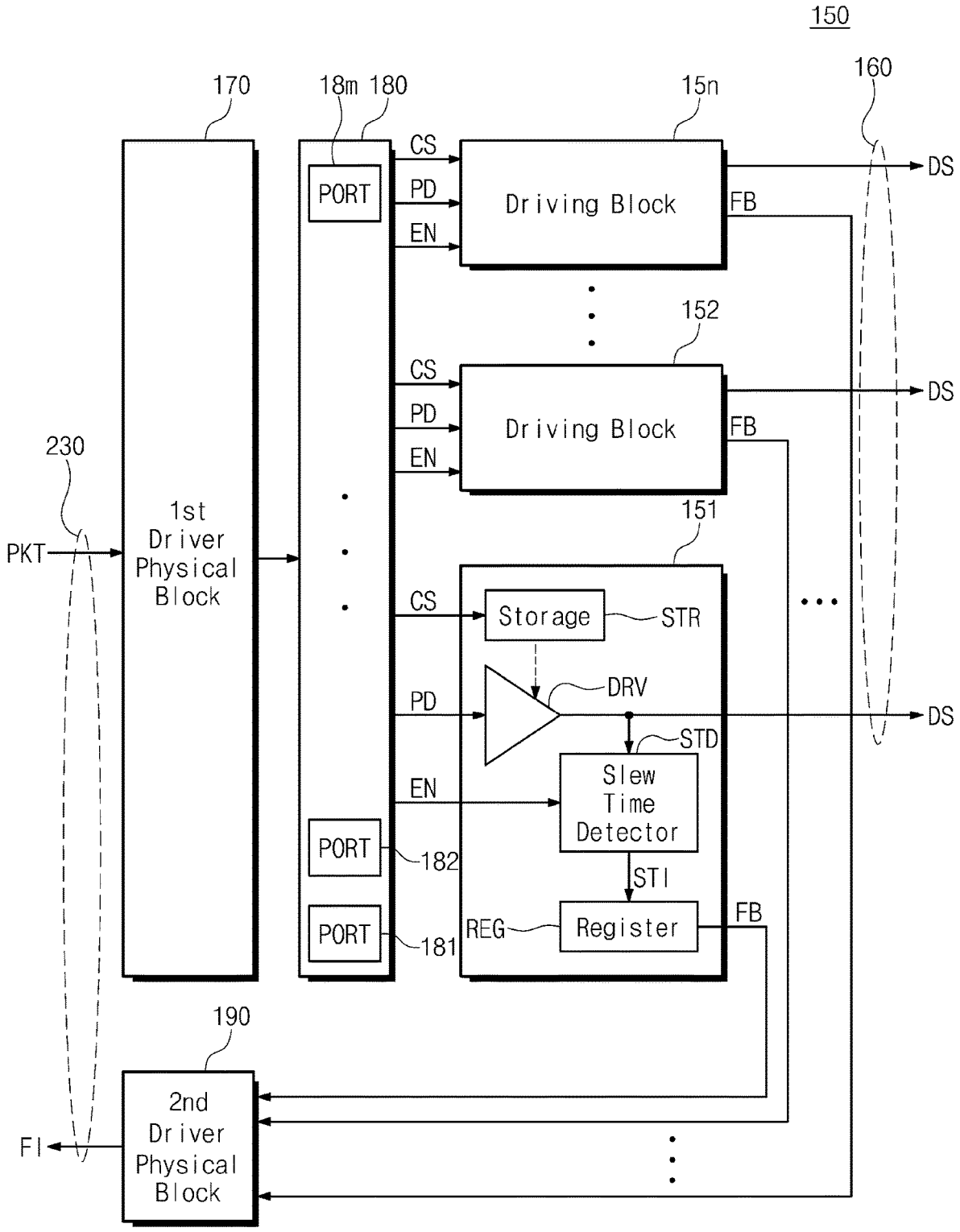
FIG. 2 is a block diagram illustrating a source driver according to at least one example embodiment of the inventive concepts.

FIG. 2 is a block diagram illustrating the source driver 150 according to at least one example embodiment of the inventive concepts. Referring to FIG. 2, the source driver 150 includes first to n-th driving blocks 151 to 15*n*, a first driver physical block 170, a port unit 180, and a second driver physical block 190, but is not limited thereto. The first driver physical block 170 may receive packets PKT from the timing controller 300 (refer to FIG. 1). The packets PKT may be transferred to the port unit 180.

The port unit 180 includes first to m-th ports 181 to 18*m*. For example, the packets PKT may be received in parallel through ports 181 to 18*m*. The number of ports 181 to 18*m* may be associated with the number of the source lines 160 or may not be associated with the number of the source lines 160 (e.g., may include an arbitrary number of ports). Information packets may be received through the ports 181 to 18*m*.

For example, the one or more packets PKT may include information packets including information regarding the voltage levels of the source lines 160, and configuration packets including information regarding a configuration and/or operation of the source driver 150. The configuration packets may be received through some ports, for example, at least one port. The port unit 180 may extract pixel data PD from the information packets, may extract (and/or generate)

a compensation signal CS from the configuration packets, and may extract (and/or identify) whether an enable signal EN is activated from the information of the configuration packets.

The first to n-th driving blocks 151 to 15*n* may be respectively connected to the source lines 160. The first to n-th driving blocks 151 to 15*n* may have the same and/or substantially same structure, but the example embodiments are not limited thereto. In at least one example embodiment, the first driving block 151 according to at least one example embodiment will be described in detail. The first driving block 151 includes storage STR (e.g., a storage device and/or memory device, etc.), a block driver DRV, a slew time detector STD, and a register REG, but is not limited thereto.

The storage STR receives the compensation signal CS from the port unit 180. The compensation signal CS may include timing (e.g., timing information) when the block driver DRV starts to control a voltage or information about a slew time. The storage STR may store the timing when the block driver DRV starts to control a voltage or the information about the slew time, included in the compensation signal CS. The storage STR may provide the stored information to the block driver DRV.

The block driver DRV receives the pixel data PD from the port unit 180. The pixel data PD may include information regarding a target level at which the block driver DRV controls a voltage of a source line corresponding to the block driver DRV. The block driver DRV may control a driving signal DS of the source line to the target level that the pixel data PD represents, based on the information from the storage STR.

The slew time detector STD may receive the enable signal EN from the port unit 180. If the enable signal EN is activated, the slew time detector STD may detect a slew time of the driving signal DS, that is, a slew time at which a voltage of a source line varies. For example, the slew time detector STD may detect a time taken for the driving signal DS to increase from 10% to 90% of the target level as the slew time, but the slew time detector STD is not limited thereto.

The slew time detector STD may store, in the register REG, slew time information STI that the slew time represents. The slew time information STI stored in the register REG may be transferred to the second driver physical block 190 as a feedback signal FB. The second to n-th driving blocks 152 to 15*n* may have the same and/or substantially similar structure as the first driving block 151, and a detailed description for the second to n-th driving blocks 152 to 15*n* is thus omitted.

The second driver physical block 190 may receive the feedback signal FB from the register REG. The second driver physical block 190 may output feedback information FI to the timing controller 300 based on the feedback signal FB. For example, the second driver physical block 190 may output the feedback information FI to the timing controller 300 at the timing specified through the configuration packets (e.g., the second driver physical block 190 may output the feedback information FI to the timing controller 300 based on the timing information included in the configuration packets).

For example, the second driver physical block 190 may sequentially output respective pieces of feedback information depending on the feedback signals from the first to n-th driving blocks 151 to 15*n*. In at least one example embodiment, the first driver physical block 170 may be different from the second driver physical block 190. The first driver physical block 170 may be a main channel between the timing controller 300 and the source driver 150, and the second driver physical block 190 may be a sideband channel between the timing controller 300 and the source driver 150, but the example embodiments are not limited thereto. For example, the first driver physical block 170 may include a combination of multiple pads, and the second driver physical block 190 may include single pad, etc.

As illustrated in FIG. 2, each of the first to n-th driving blocks 151 to 15*n* of the source driver 150 according to at least one example embodiment of the inventive concepts includes the slew time detector STD. The slew time detector STD may detect a slew time at timing specified by the configuration packets (and/or based on information included in the configuration packets). The slew time information STI is transferred to the timing controller 300 as the feedback information FI.

The source driver 150 may receive the compensation signal CS through the configuration packets received from the timing controller 300 and may update an existing compensation signal CS. That is, the source driver 150 may report information regarding a slew time representing a charging rate to the timing controller 300 and may update the compensation signal CS under the control of the timing controller 300. Accordingly, the source driver 150 may adjust a charging rate under the control of the timing controller 300, or in other words, the timing controller 300 may adjust the charging rate of the source driver 150 based on the detected slew time information.

Figure 3:
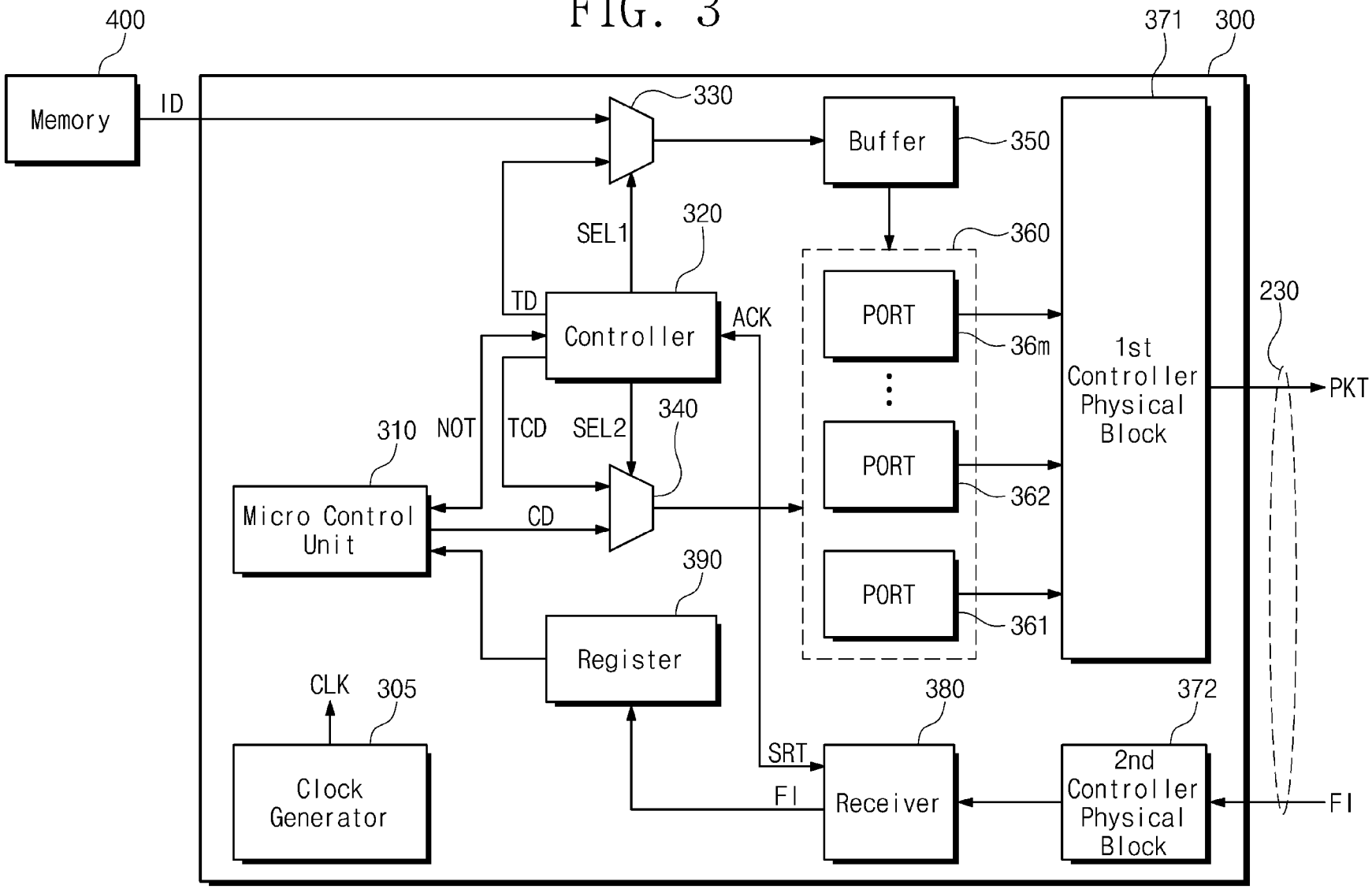
FIG. 3 is a block diagram illustrating a timing controller and a memory according to at least one example embodiment of the inventive concepts.

FIG. 3 is a block diagram illustrating the timing controller 300 and the memory 400 according to at least one example embodiment of the inventive concepts. Referring to FIGS. 1 and 3, the timing controller 300 includes a clock generator 305, a micro control unit 310, a controller 320, a first multiplexer 330, a second multiplexer 340, a buffer 350, a port unit 360, a first controller physical block 371, a second controller physical block 372, a receiver 380, and a register 390, etc., but the example embodiments are not limited thereto.

The clock generator 305 may generate a clock signal CLK. The clock signal CLK may be a signal that transitions between a high level and a low level at a regular period and/or interval (e.g., a clock cycle). The clock signal CLK may be transferred to necessary elements within the timing controller 300. To improve the clarity of FIG. 3, paths through which the clock signal CLK is transferred are omitted in FIG. 3.

The micro control unit 310 may control the operations and/or normal operations of the timing controller 300. In a normal mode, the micro control unit 310 may generate the configuration packets based on internal information stored in the micro control unit 310. In a compensation mode, the micro control unit 310 may instruct the controller 320 to detect a slew time and to obtain the feedback information FI. In the compensation mode, the micro control unit 310 may read the feedback information FI from the register 390 and may update the configuration packets based on the feedback information FI.

In the compensation mode, the controller 320 may instruct the source drivers 150 to detect a slew time and to report the detected slew time as the feedback information FI. In the compensation mode, the controller 320 may transfer test data TD to the first multiplexer 330. In the compensation mode, the controller 320 may control a first selection signal SEL1 such that the test data TD from the controller 320 are selected in the first multiplexer 330. In the normal mode, the controller 320 may control the first selection signal SEL1 such that image data ID from the memory 400 (e.g., memory device) are selected in the first multiplexer 330.

In the compensation mode, the controller 320 may transfer test configuration data TCD to the second multiplexer 340. In the compensation mode, the controller 320 may control a second selection signal SEL2 such that the test configuration data TCD from the controller 320 are selected in the second multiplexer 340. In the normal mode, the controller 320 may control the second selection signal SEL2 such that configuration data CD from the micro control unit 310 are selected in the second multiplexer 340.

In the compensation mode, the controller 320 may transfer a start signal SRT providing notification that detection of a slew time starts to the receiver 380. In the compensation mode, when an acknowledge ACK signal is received from the receiver 380, the controller 320 may provide the micro control unit 310 with a notification NOT providing notification that the feedback information FI is obtained.

The first multiplexer 330 may receive the image data ID from the memory 400 and may receive the test data TD from the controller 320. The first multiplexer 330 may output one of the image data ID and the test data TD to the buffer 350 in response to the first selection signal SEL1 output from the controller 320. In the compensation mode, the first multiplexer 330 may output the test data TD. In the normal mode, the first multiplexer 330 may output the image data ID.

The second multiplexer 340 may receive the configuration data CD from the micro control unit 310 and may receive the test configuration data TCD from the controller 320. The second multiplexer 340 may output one of the configuration data CD and the test configuration data TCD to the port unit 360 in response to the second selection signal SEL2 output from the controller 320. In the compensation mode, the second multiplexer 340 may output the test configuration data TCD. In the normal mode, the second multiplexer 340 may output the configuration data CD.

The buffer 350 may store data output from the first multiplexer 330. The buffer 350 may distribute the stored data into first to m-th ports 361 to 36*m* of the port unit 360. In the compensation mode, the buffer 350 may transfer the test data TD to the port unit 360. In the normal mode, the buffer 350 may transfer the image data ID to the port unit 360. For example, the buffer 350 may be a pixel line buffer, but the example embodiments are not limited thereto.

The port unit 360 includes the first to m-th ports 361 to 36*m*. According to at least one example embodiment, the first to m-th ports 361 to 36*m* may form parallel channels, but the example embodiments are not limited thereto and the port unit 360 may use serial communications. The first to m-th ports 361 to 36*m* may transfer data from the buffer 350 to the first controller physical block 371. In the compensation mode, the first to m-th ports 361 to 36*m* may transfer the test data TD to the first controller physical block 371. In the normal mode, the first to m-th ports 361 to 36*m* may transfer the image data ID to the first controller physical block 371.

At least one of the first to m-th ports 361 to 36*m* may transfer data from the second multiplexer 340 to the first controller physical block 371. In the compensation mode, at least one of the first to m-th ports 361 to 36*m* may transfer the test configuration data TCD to the first controller physical block 371. In the normal mode, at least one of the first to m-th ports 361 to 36*m* may transfer the configuration data TD to the first controller physical block 371.

In at least one example embodiment, the first to m-th ports 361 to 36*m* may packetize data stored in the buffer 350 and data from the second multiplexer 340 to the packets PKT. The first to m-th ports 361 to 36*m* may transfer the packets PKT to the first controller physical block 371. The first controller physical block 371 may transfer the packets PKT received from the first to m-th ports 361 to 36*m* to the source drivers 150. In at least one example embodiment, the packets PKT may be transferred in common (e.g., in parallel, etc.) to the source drivers 150 and may be transferred to a destination in a peer-to-peer manner.

The second controller physical block 372 may receive the feedback information FI from the source drivers 150. The second controller physical block 372 may be different from the first controller physical block 371 according to some example embodiments. The first controller physical block 371 may be a main channel between the timing controller 300 and the source driver 150, and the second controller physical block 372 may be a sideband channel between the timing controller 300 and the source driver 150, but the example embodiments are not limited thereto. The first controller physical block 371 may include a combination of multiple pads, and the second controller physical block 372 may include single pad, but the example embodiments are not limited thereto.

The receiver 380 may receive the feedback information FI through the second controller physical block 372. For example, when a start signal SRT is received from the controller 320 in the compensation mode, the receiver 380 may receive the feedback information FI through the second controller physical block 372. The receiver 380 may store the received feedback information FI in the register 390. After storing the feedback information FI in the register 390, the receiver 380 may transfer an acknowledge signal ACK to the controller 320.

The memory 400 may store the image data ID. The memory 400 may be included in a system that includes the timing controller 300 and the source drivers 150. The memory 400 may include, for example, a random access memory (RAM), a dynamic RAM (DRAM), a synchronous DRAM (SDRAM), a double date rate SDRAM (DDR SDRAM), a graphics DDR SDRAM (GDDR SDRAM), etc., but are not limited thereto.

As described with reference to FIG. 3, in the compensation mode, the timing controller 300 may transfer the test data TD and the test configuration data TCD to the source drivers 150. In response to the test configuration data TCD, the source drivers 150 may detect slew times by using the test TD. The timing controller 300 may obtain slew times as the feedback information FI.

Based on the obtained feedback information F1, the timing controller 300 may update the configuration data CD and may transfer the updated configuration data CD to the source drivers 150. The source drivers 150 may be updated depending on (e.g., based on) the updated pieces of configuration data. For example, the timing controller 300 may update the source drivers 150 such that the source drivers 150 uniformly control voltages of the source lines 160. Accordingly, it may be possible to compensate for differences between the charging rates of the source drivers 150.

Figure 4:
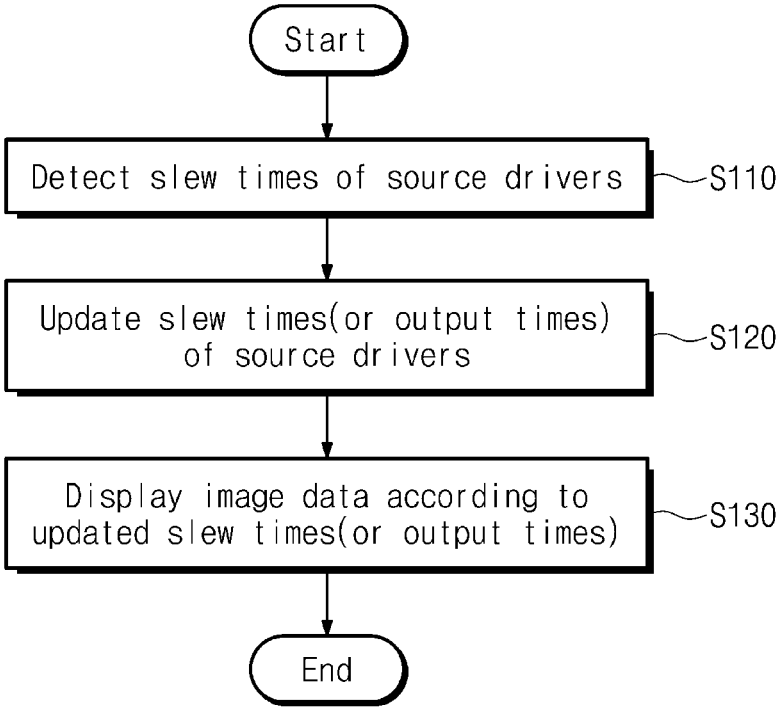
FIG. 4 illustrates an example of an operating method of a display driving device including source drivers and the timing controller according to at least one example embodiment of the inventive concepts.

FIG. 4 illustrates an example of an operating method of a display driving device including the source drivers 150 and the timing controller 300 according to at least one example embodiment of the inventive concepts. Referring to FIGS. 1 to 4, operation S110 and operation S120 may correspond to the compensation mode. Operation S130 may correspond to the normal mode.

In operation S110, the timing controller 300 may detect slew times of the source drivers 150. For example, the micro control unit 310 may control the timing controller 300 such that the timing controller 300 enters the compensation mode.

The controller 320 may control one or more selection signals, e.g., the first and second selection signals SEL1 and SEL2, so that the first multiplexer 330 outputs the test data TD and the second multiplexer 340 outputs the test configuration data TCD when in the compensation mode.

The port unit 360 may packetize the test data TD and the test configuration data TCD to the packets PKT. The packets PKT may be transferred to the source drivers 150. The source drivers 150 may detect the slew times and may output the detected slew times as the feedback information FI.

The controller 320 may request the receiver 380 to read the feedback information FI through the start signal S RT. The receiver 380 may receive the feedback information FI from the second controller physical block 372 in response to the start signal SRT. As another example, the receiver 380 may read the feedback signal FB stored in registers as the feedback information FI through the second controller physical block 372 and second physical blocks of the source drivers 150.

The receiver 380 may store the feedback information FI in the register 390. After storing the feedback information FI, the receiver 380 may transfer an acknowledge signal ACK to the controller 320. The controller 320 may transfer the notification signal NOT to the micro control unit 310 in response to the acknowledge signal ACK.

In at least one example embodiment, the acknowledge signal ACK and the notification signal NOT may be transferred in an interrupt manner or a polling manner. In the interrupt manner, the controller 320 may wait until the acknowledge signal ACK is received from the receiver 380, and the micro control unit 310 may wait until the notification signal NOT is received from the controller 320.

In the polling manner, the controller 320 may periodically read a specific register (not illustrated) of the receiver 380 while performing other operations. The receiver 380 may store a specific value in the specific register when the feedback information FI is completely stored. When the controller 320 reads the specific register of the receiver 380, the acknowledge signal ACK may be transferred from the receiver 380 to the controller 320 if the specific value is stored in the specific register.

Likewise, in the polling manner, the micro control unit 310 may periodically read a specific register (not illustrated) of the controller 320 while allowing and/or performing other tasks. When the micro control unit 310 reads the specific register of the controller 320, the notification signal NOT may be transferred from the controller 320 to the micro control unit 310 if the specific value is stored in the specific register.

In operation S120, the timing controller 300 may update the slew times (or output times) of the source drivers 150. The micro control unit 310 may read the feedback information FI stored in the register 390 in response to the notification signal NOT. The micro control unit 310 may adjust the voltage control ways of the source drivers 150 based on the feedback information FI such that the source drivers 150 uniformly controls voltages of the source lines 160, or in other words, the source drivers 150 compensate for the detected slew times by controlling the voltages of the source lines.

For example, the micro control unit 310 may calculate how much a slew time (or output time) of any one of the plurality of source drivers 150 is to be adjusted. The micro control unit 310 may update a part of the configuration data CD representing the slew times (or output times) of the one or more source drivers 150 based on the calculation result.

In at least one example embodiment, operation S120 may be completed by updating the configuration data CD. The updated configuration data CD may be transferred to the source driver 150 along with the image data ID in the normal mode. As another example, operation S120 may be completed by transferring the updated configuration data CD to the source drivers 150. The controller 320 may control the first and second selection signals SEL1 and SEL2 such that the first multiplexer 330 outputs the test data TD and the second multiplexer 340 outputs the configuration data CD.

In at least one example embodiment, as described with reference to FIG. 2, values of two or more feedback signals FB may be obtained from one source driver as the feedback information FI. The micro control unit 310 may obtain final feedback information by computing values included in the feedback information FI of the corresponding source driver.

For example, the micro control unit 310 may obtain an average value, a median value, a minimum value, a maximum value, etc., of the values included in the feedback information FI as the final feedback information. The micro control unit 310 may calculate a slew time or output time by using the final feedback information.

As another example, the micro control unit 310 may differently control (or update) slew times or output times of the first to n-th driving blocks 151 to 15*n* of a source driver by using values of the feedback information FI received from the source driver. In other words, the micro control unit 310 may control (or update) the slew times or output times of one or more of the first to n-th driving blocks 151 to 15*n* of a source driver individually and/or collectively based on the feedback information FI received from the source driver.

In operation S130, the timing controller 300 may display the image data ID depending on the updated slew times (or output times) (e.g., the timing controller 300 may control the source drivers 150 to output the image data ID to the display panel 120). For example, the micro control unit 310 may control the timing controller 300 such that the timing controller 300 enters the normal mode after the operation S120 completes.

In the normal mode, the controller 320 may control the first selection signal SEL1 such that the image data ID are transferred to the buffer 350. The controller 320 may control the second selection signal SEL2 such that the updated configuration data CD are transferred to the port unit 360. The port unit 360 may packetize the image data ID and the updated configuration data CD to the packets PKT and may transfer the packets PKT to the source drivers 150.

Each of the source drivers 150 may update the compensation signal CS stored in the storage STR depending on the configuration data CD included in the packets PKT. The block driver DRV may control the driving signal DS depending on the pixel data PD based on the updated compensation signal. Since voltages of the source lines 160 are controlled depending on the updated compensation signal CS, the source drivers 150 may uniformly drive (or control) the voltages of the source lines 160 to compensate for any slew time detected on any of the source lines.

Figure 5:
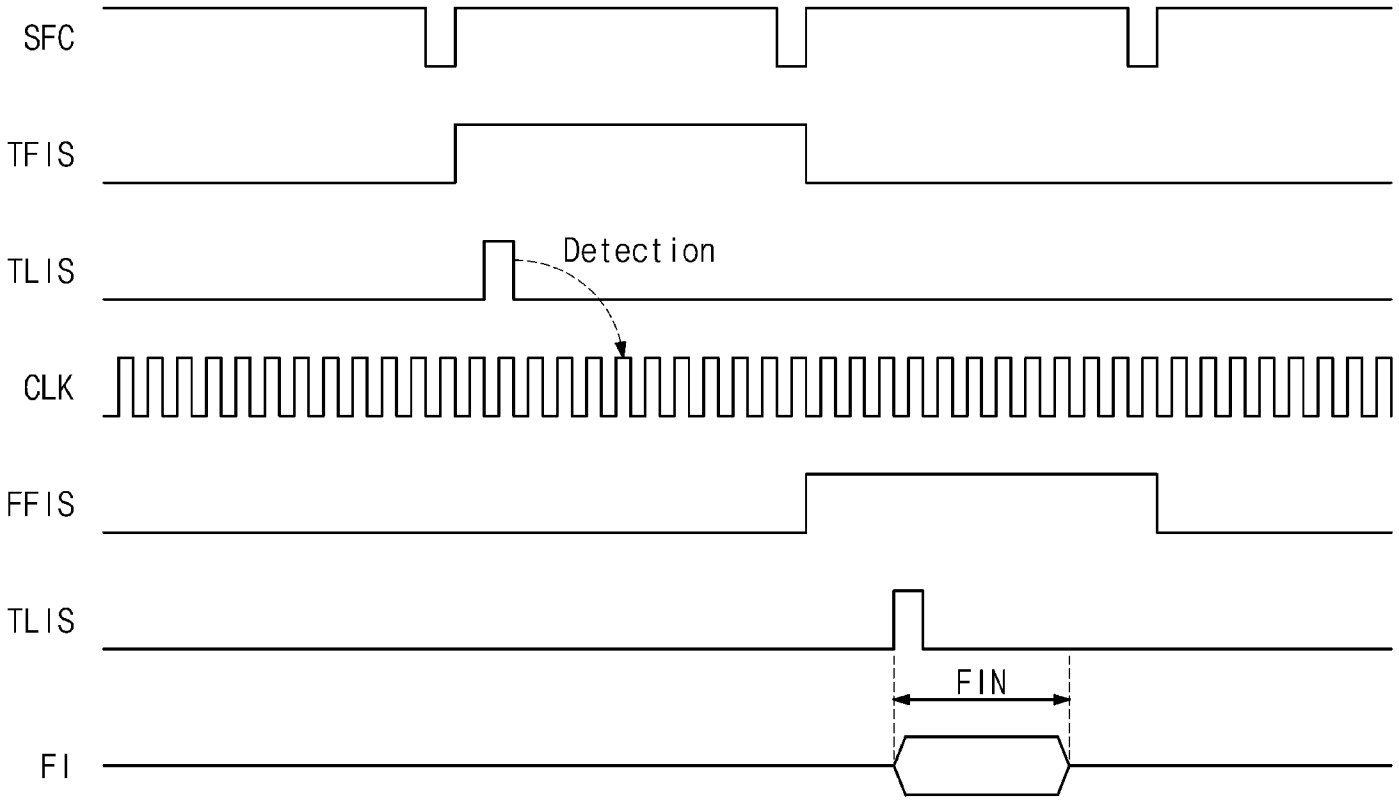
FIG. 5 illustrates an example in which the timing controller controls the source drivers according to at least one example embodiment of the inventive concepts.

FIG. 5 illustrates an example in which the timing controller 300 controls source drivers according to at least one example embodiment. Referring to FIGS. 2, 3, and 5, there are illustrated changes of a start frame control signal SFC, a test frame indication signal TFIS, a test line indication signal TLIS, a clock signal CLK, a feedback frame indication signal FFIS, a feedback line indication signal FLIS, and the feedback information FI over time.

The start frame control signal SFC may notify a start of the packets PKT. At a start of a frame of the packets PKT, the start frame control signal SFC may transition to a low level and then may transition to a high level. In at least one example embodiment, the start frame control signal SFC may include one or more bits placed at the head of the frame.

The test frame indication signal TFIS may specify a test frame to detect a slew time. When the test frame indication signal TFIS is activated (e.g., has a high level), the source driver 150 may recognize that there is a need to detect a slew time in the current frame.

In at least one example embodiment, the test frame indication signal TFIS is illustrated as having a high level while one frame is transferred. However, this is an example for describing the scope and spirit of the inventive concepts more easily, and the example embodiments are not limited thereto. For example, the test frame indication signal TFIS may be one bit included in a frame or may be bits that are periodically repeated in the frame.

In the test frame, the test line indication signal TLIS is activated at specific timing. The test line indication signal TLIS may specify a test line to detect a slew time. In at least one example embodiment, the test line indication signal TLIS may be one bit included in a frame. The test line indication signal TLIS may be a bit repeated in a frame and may have an active value at a detection point in time.

A slew time may be detected after the test line indication signal TLIS is activated and desired and/or predefined clock cycles of the clock signal CLK elapse. For example, a slew time may be detected when the first and second gate drivers 131 and 133 select pixels of a blank area. The blank area may be covered by a bezel and may be an area invisible (e.g., not visible) to a user.

The feedback frame indication signal FFIS may specify a feedback frame to obtain feedback information. When the feedback frame indication signal FFIS is activated (e.g., has a high level), the source driver 150 may recognize that there is a desire and/or need to detect the feedback information FI in a current frame.

In at least one example embodiment, the feedback frame indication signal FFIS is illustrated as having a high level while one frame is transferred. However, this is an example for describing the scope and spirit of the inventive concepts more easily, and the example embodiments are not limited thereto. For example, the feedback frame indication signal FFIS may be one bit included in a frame or may be bits that are periodically repeated in the frame, etc.

In the feedback frame, the feedback line indication signal FLIS is activated at specific timing. The feedback line indication signal FLIS may specify timing (e.g., a line location) at which the feedback information FI is output. In at least one example embodiment, the feedback line indication signal FLIS may be one bit included in a frame, but the example embodiments are not limited thereto. The feedback line indication signal FLIS may be a bit repeated in a frame and may have an active value at a detection point in time.

As the feedback line indication signal FLIS is activated, the source drivers 150 may output the feedback information FI during a feedback interval FIN. As another example, the timing controller 300 may read the feedback information FI from the source drivers 150 during the feedback interval FIN.

Figure 6:
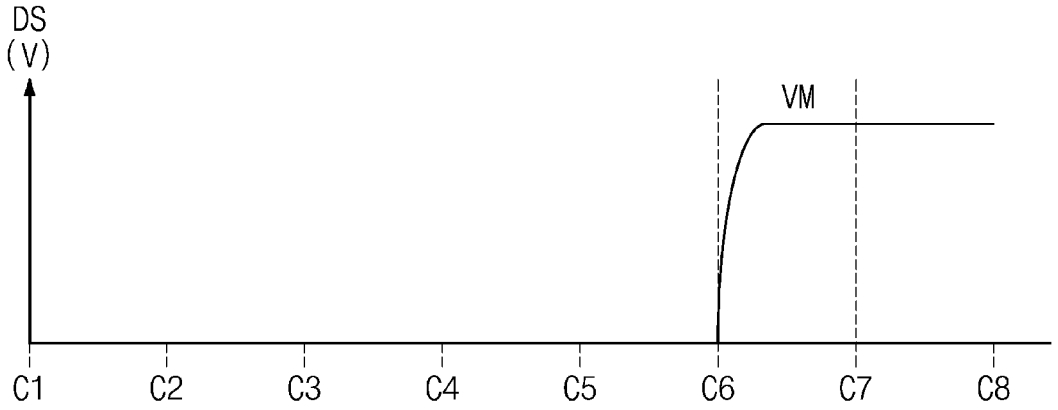
FIG. 6 illustrates an example in which the source driver controls voltages of source lines depending on test data and test configuration data according to at least one example embodiment of the inventive concepts.

FIG. 6 illustrates an example in which the source driver 150 controls voltages of source lines 160 (i.e., the driving signals DS) depending on the test data TD and test configuration data TCD according to at least one example embodiment. In FIG. 6, a horizontal axis represents clock cycles of the clock signal CLK, and a vertical axis represents a voltage V of the driving signal DS.

Referring to FIGS. 2, 3, 5, and 6, during specific clock cycles after the test line indication signal TLIS is activated, the source driver 150 may maintain a minimum value (e.g., +0 or −0) at a positive polarity (or negative polarity). At least one example embodiment is illustrated in FIG. 6 as the source driver 150 maintains a minimum value (e.g., +0) during first to fifth clock cycles C1 to C5, but the example embodiments are not limited thereto.

If a voltage of the driving signal DS is maintained during the first to fifth clock cycles C1 to C5, external factors such as noise may be excluded, and the driving signal DS may be stabilized. In a sixth clock cycle C6, the source driver 150 may control the driving signal DS from a positive polarity (or negative polarity) to a maximum value VM in response to the test data TD and the test configuration data TCD. For example, for even a sixth clock cycle C7, the driving signal DS may be maintained at the maximum value VM.

For example, the slew time detector STD of the source driver 150 may detect a slew time in the sixth clock cycle C6. Accordingly, the slew time detector STD may detect a slew time when the driving signal DS changes from a minimum value to a maximum value at a specific polarity. An example of slew times that the source driver 150 detects is illustrated in FIG. 7.

Figure 7:
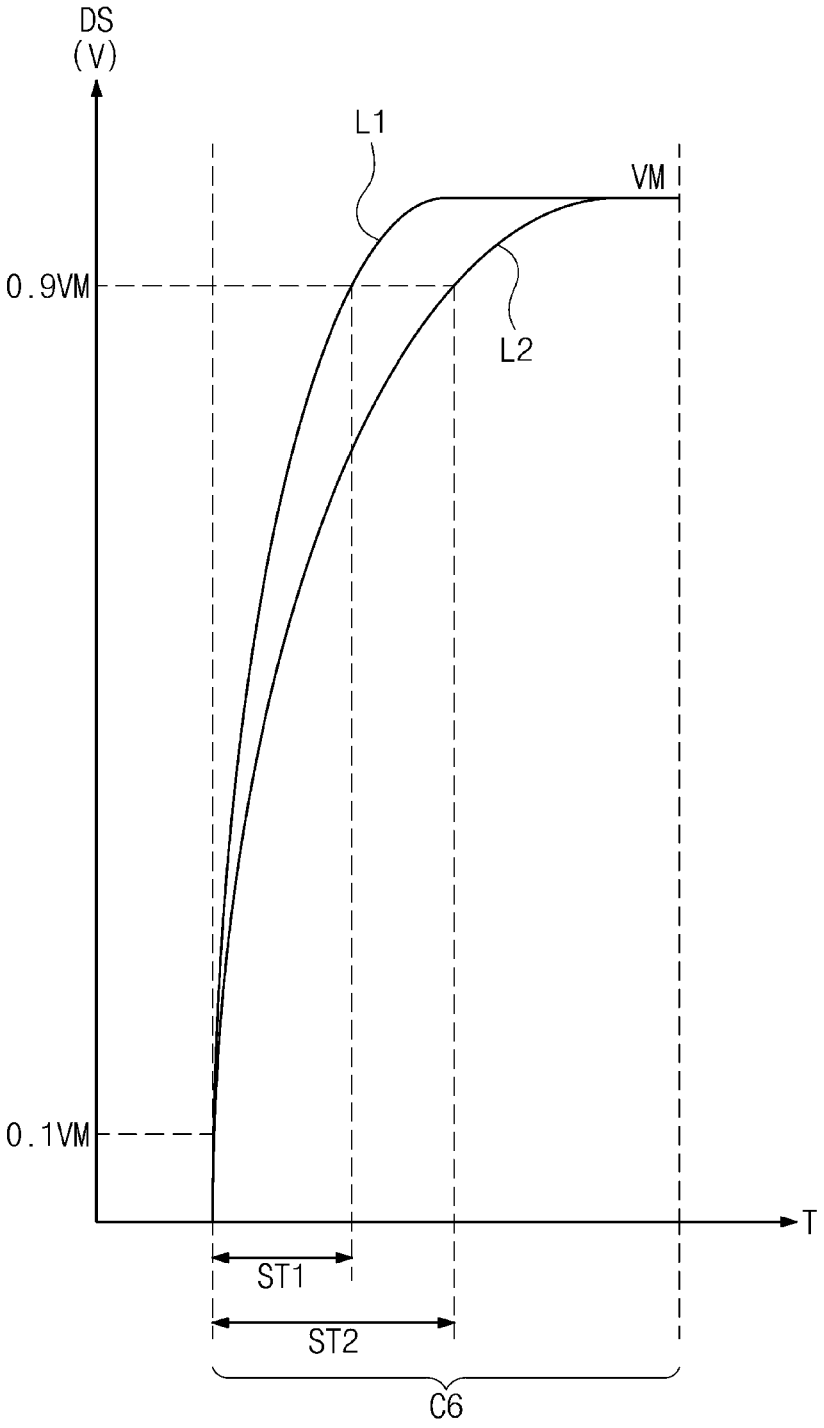
FIG. 7 illustrates an example of slew times detected in the source drivers according to at least one example embodiment of the inventive concepts.

FIG. 7 illustrates an example of slew times detected in the source drivers 150 according to at least one example embodiment. In FIG. 7, a horizontal axis represents a time T, and a vertical axis represents a voltage V of the driving signal DS. Referring to FIGS. 1 and 7, the driving signals DS of the source drivers 150 may vary along a first line L1 and a second line L2. In at least one example embodiment, it is assumed that a driver to drive the driving signal DS along the first line L1 is a first source driver and a driver to drive the driving signal DS along the second line L2 is a second source driver, but the example embodiments are not limited thereto.

For example, a slew time may refer to a time when the driving signal DS changes from 10% of the maximum value VM, that is, 0.1 VM to 90% of the maximum value VM, that is, 0.9 VM, but the example embodiments are not limited thereto. The first source driver may drive the driving signal DS with the maximum value VM more quickly than the second source driver. Accordingly, a first slew time ST1 of the first source driver is shorter than a second slew time ST2 of the second source driver.

The driving signal DS of the first source driver may be driven more quickly than the driving signal DS of the second source driver. Accordingly, a charging rate of the first source driver may be lower than a charging rate of the second source driver. If the charging rates of the first source driver and the second source driver are different from each other, a decrease in the image quality, such as block dim, may occur in the display panel 120.

Figure 8:
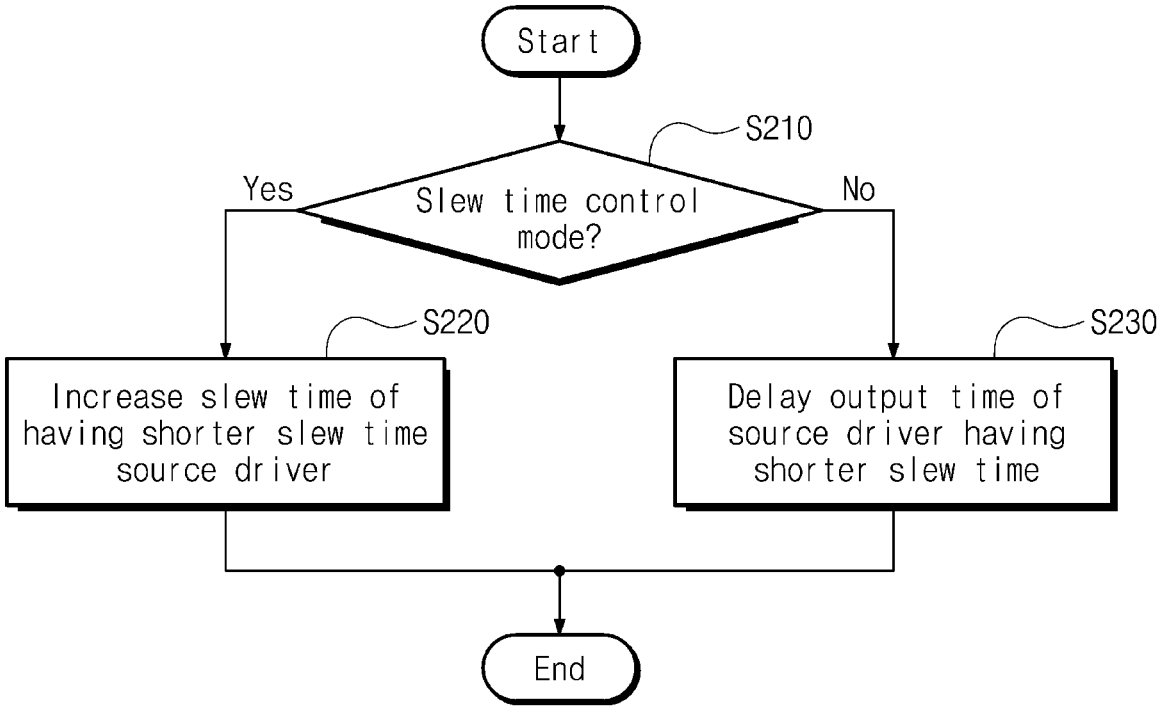
FIG. 8 illustrates an example in which the timing controller updates a voltage control manner of a driver according to at least one example embodiment of the inventive concepts.

FIG. 8 illustrates an example in which the timing controller 300 updates a voltage control manner of the source driver 150 according to at least one example embodiment. Referring to FIGS. 2, 3, and 8, in operation S210, the micro control unit 310 may determine whether a compensation mode is a slew time control mode (e.g., a first mode). For example, the compensation mode may be determined by an external user and/or through communication with an external device.

If the compensation mode is determined to be the slew time control mode by the micro control unit 310, operation S220 is performed. In operation S220, the micro control unit 310 may increase a slew time of a source driver that has a slew time shorter than another source driver (e.g., one or more other source drivers). For example, the micro control unit 310 may update the configuration data CD such that a slew time of the corresponding source driver increases. Afterwards, updating of the voltage control manner for the source drivers is completed. As another example, the micro control unit 310 may decrease a slew time of a source driver that has a slew time longer than another source driver (e.g., one or more other source drivers).

If the compensation mode is not the slew time control mode, the compensation mode may be an output time control mode (e.g., a second mode). In operation S230, the micro control unit 310 may delay an output time of a source driver that has an output time shorter than another source driver. The output time may be time when the source driver 150 starts to adjust voltages of the driving signal DS according to the image data ID or the test data TD. For example, the micro control unit 310 may update the configuration data CD such that an output time is delayed. Afterwards, updating of the voltage control manner is completed. As another example, the micro control unit 310 may advance an output time of a source driver that has a slow time longer than another source driver.

Referring to FIGS. 7 and 8, in the slew time control mode, the first slew time ST1 may increase to the second slew time ST2 such that the first line L1 of the first source driver coincides with the second line L2 of the second source driver. As another example, the second slew time ST2 may decrease to the first slew time ST1 such that the second line L2 of the second source driver having a longer slew time coincides with the first line L1 of the first source driver.

Figure 9:
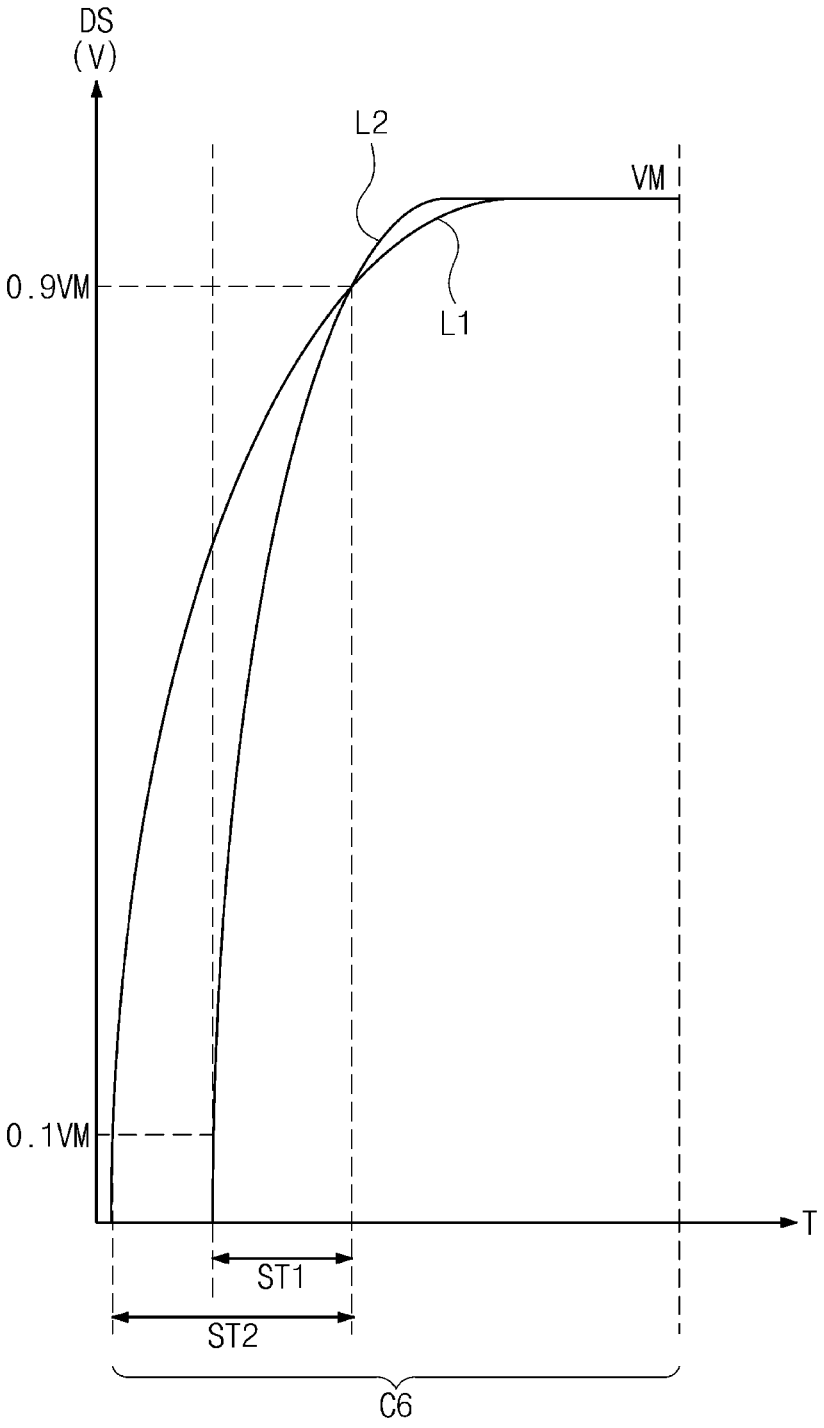
FIG. 9 illustrates an example in which a voltage control manner is updated in an output time control mode according to at least one example embodiment of the inventive concepts.

FIG. 9 illustrates an example in which a voltage control manner is updated in an output time control mode according to at least one example embodiment. In FIG. 9, a horizontal axis represents a time T, and a vertical axis represents a voltage V of the driving signal DS. Compared with FIG. 7, an output time of the first source driver (i.e., a starting time to control the driving signal DS) may be delayed such that points in time when the first and second slew times ST1 and ST2 end coincide with each other.

For example, the micro control unit 310 may delay an output time of the first source driver by differences between the first and second slew times ST1 and ST2. If the output time of the first source driver is delayed, a point in time when the first and second lines L1 and L2 reach the maximum value VM may become faster compared with FIG. 7. Accordingly, the first and second source drivers uniformly controls voltages of the driving signals DS, and it is possible to compensate for differences between charging rates of the first and second source drivers. However, the example embodiments are not limited thereto and the number of source drivers and may be greater or lesser than two.

Figure 10:
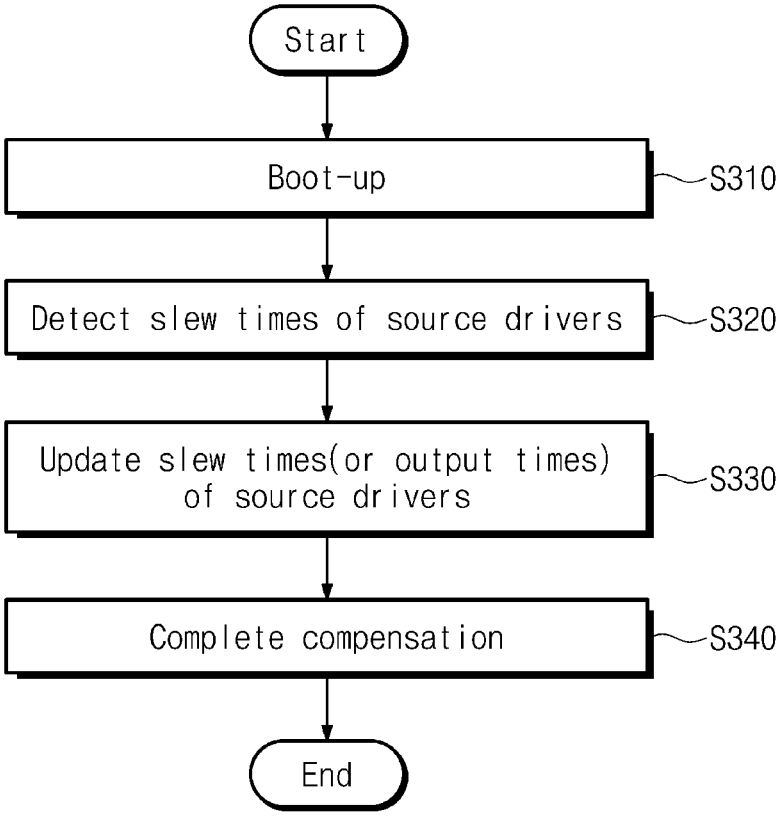
FIG. 10 is a flowchart illustrating an example in which the timing controller controls the source drivers according to at least one example embodiment of the inventive concepts.

FIG. 10 is a flowchart illustrating an example in which the timing controller 300 updates the source drivers 150 according to at least one example embodiment. Referring to FIGS. 1 and 10, in operation S310, the timing controller 300 and the source drivers 150 may perform boot-up. For example, when power is supplied, when a soft reset is performed, and/or when a cold reset is performed, the timing controller 300 and the source drivers 150 may perform boot-up (e.g., may perform a boot-up operation).

After performing the boot-up, in operation S320, the timing controller 300 may detect the slew times of the source drivers 150. Operation S320 may be performed similarly to operation S110. In operation S330, the timing controller 300 may update the slew times (or output times) of the source drivers 150. Operation S330 may be performed similarly to operation S120. In operation S340, the timing controller 300 may terminate compensation mode and may enter the normal mode.

As described with reference to FIG. 10, after performing the boot-up, the timing controller 300 may immediately enter the compensation mode without entering the normal mode. The timing controller 300 may also enter the normal mode after completing the compensation mode. The timing controller 300 may not display the image data ID (refer to FIG. 3) until updating of the source drivers is completed after boot-up.

In FIG. 10, the compensation mode of operation S320 to operation S340 is described as being performed after boot-up. However, the compensation mode of operation S320 to operation S340 is not limited to the case of being performed after boot-up. For example, the compensation mode of operation S320 to operation S340 may be changed or modified to be included in boot-up, etc.

Figure 11:
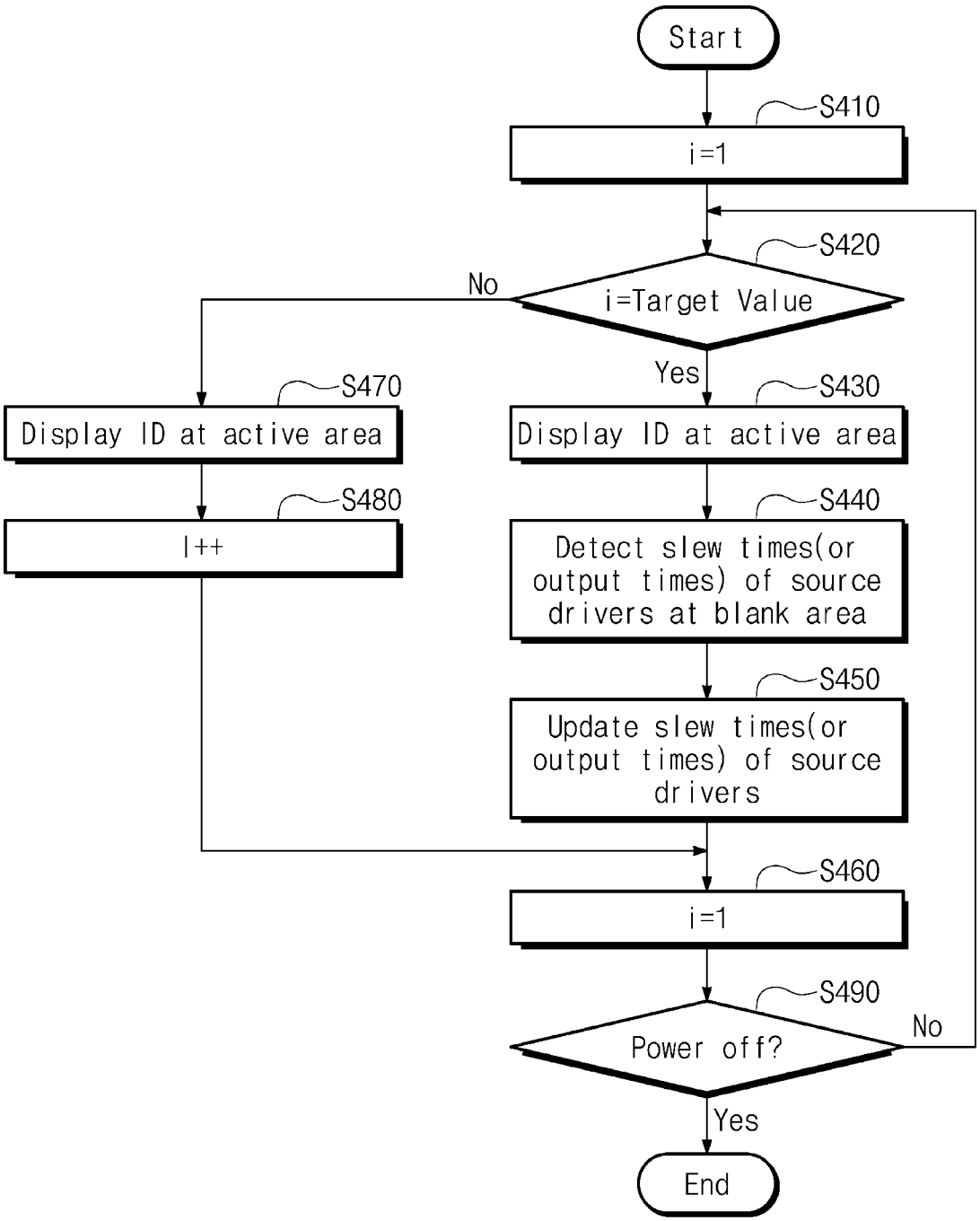
FIG. 11 is a flowchart illustrating an application in which the timing controller updates the source drivers according to at least one example embodiment of the inventive concepts.

FIG. 11 is a flowchart illustrating an application in which the timing controller 300 updates the source drivers 150 according to at least one example embodiment. Referring to FIGS. 1 and 11, in operation S410, the timing controller 300 may initialize a variable "i" to "1". In operation S420, the timing controller 300 may determine whether the variable "i" is the same as a target value. If the variable "i" is the same as the target value, operation S430 to operation S460 may be performed. If the variable "i" is different from the target value, operation S470 and operation S480 may be performed.

If the variable "i" is the same as the target value, in operation S430, the timing controller 300 may display the image data ID at an active area of the display panel 120. The active area may not be covered by a bezel and may be an area of the display panel 120 visible to the user. In operation S440, the timing controller 300 may detect slew times of the source drivers 150 in the blank area of the display panel 120. Operation S440 may be performed similarly to operation S110.

In operation S450, the timing controller 300 may update the slew times (or output times) of the source drivers 150. Operation S450 may be performed similarly to operation S120. In operation S460, the timing controller 300 may initialize the variable "i" to "1". Afterwards, operation S490 is performed.

If the variable "i" is different from the target value, in operation S470, the timing controller 300 may display the image data ID at the active area of the display panel 120. In operation S480, the timing controller 300 may increase the variable "i". For example, the timing controller 300 may increase the variable "i" by "1". Afterwards, operation S490 is performed.

In operation S490, the timing controller 300 may determine whether power is off. If the power is not off, the timing controller 300 may perform operation S420. If the power is off, the timing controller 300 may terminate the process. For example, the power-off may include a cold reset or a soft reset.

As described with reference to FIG. 11, the timing controller 300 may periodically and/or at desired times (e.g., based on a user instruction, or based on a detected condition, etc.) enter the compensation mode while power is supplied. In at least one example embodiment, the timing controller 300 may perform the process illustrated in FIG. 11 in each frame. That is, the timing controller 300 may enter the compensation mode in units of frames corresponding to the target value.

In the compensation mode, detection of a slew time is performed in the blank area. Accordingly, the user cannot view voltages of source lines changing from a minimum value to a maximum value in the display device 100. That is, detecting a slew time may be shadowed and may not cause trouble and/or inconvenience for the user to use the display device 100.

Also, obtaining the information regarding a slew time as the feedback information FI (refer to FIGS. 2 and 3) may be performed by the second driver physical block 190 and the second controller physical block 372. Updating of the source drivers 150 is performed by using the configuration data CD, not the image data ID. Accordingly, the obtaining of the feedback information FI and the updating of the source drivers 150 may not cause a trouble for the user to use the display device 100.

Figure 12:
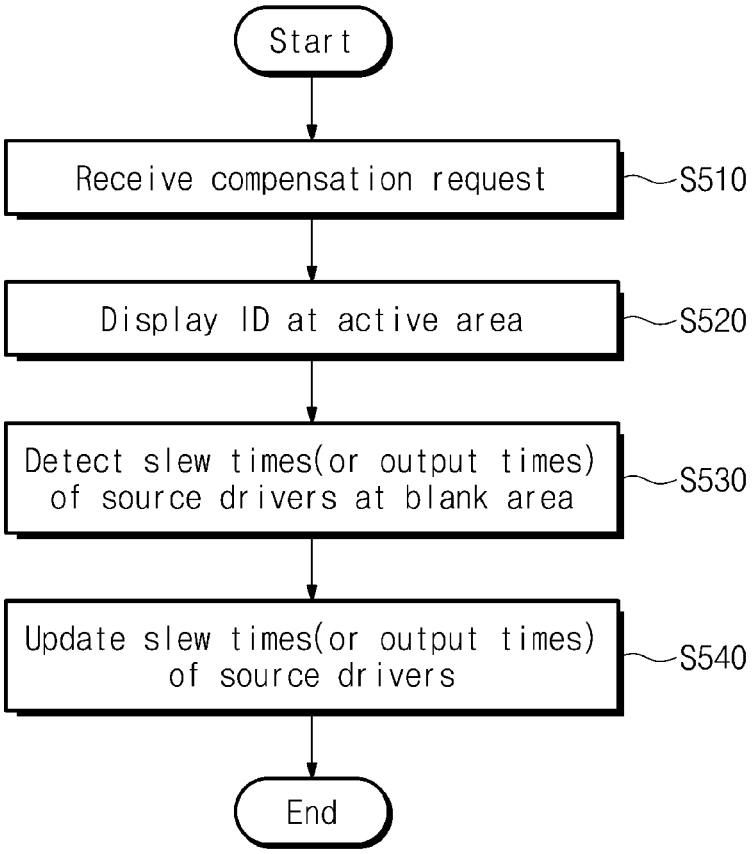
FIG. 12 is a flowchart illustrating an application in which the timing controller updates the source drivers according to at least one example embodiment of the inventive concepts.

FIG. 12 is a flowchart illustrating an application in which the timing controller 300 updates the source drivers 150 according to at least one example embodiment. Referring to FIGS. 1 and 12, in operation S510, the timing controller 300 may receive a compensation request. For example, the compensation request may be generated in the micro control unit 310 (refer to FIG. 3) or may be received from an external device of the timing controller 300.

In operation S520, the timing controller 300 may display the image data ID at the active area of the display panel 120. In operation S530, the timing controller 300 may detect slew times of the source drivers 150 in the blank area of the display panel 120 in response to the compensation request. Operation S530 may be performed similarly to operation S110. In operation S540, the timing controller 300 may update the slew times (or output times) of the source drivers 150. Operation S540 may be performed similarly to operation S120.

As described with reference to FIG. 12, the timing controller 300 may enter the compensation mode depending on an internal and/or external request of the timing controller 300. For example, as described with reference to FIG. 11, the timing controller 300 may perform an operation of periodically entering the compensation mode depending on an internal and/or external request. For example, the timing controller 300 may perform an operation of periodically entering the compensation mode during the specific number of periods (e.g., three periods) depending on an internal and/or external request.

Figure 13:
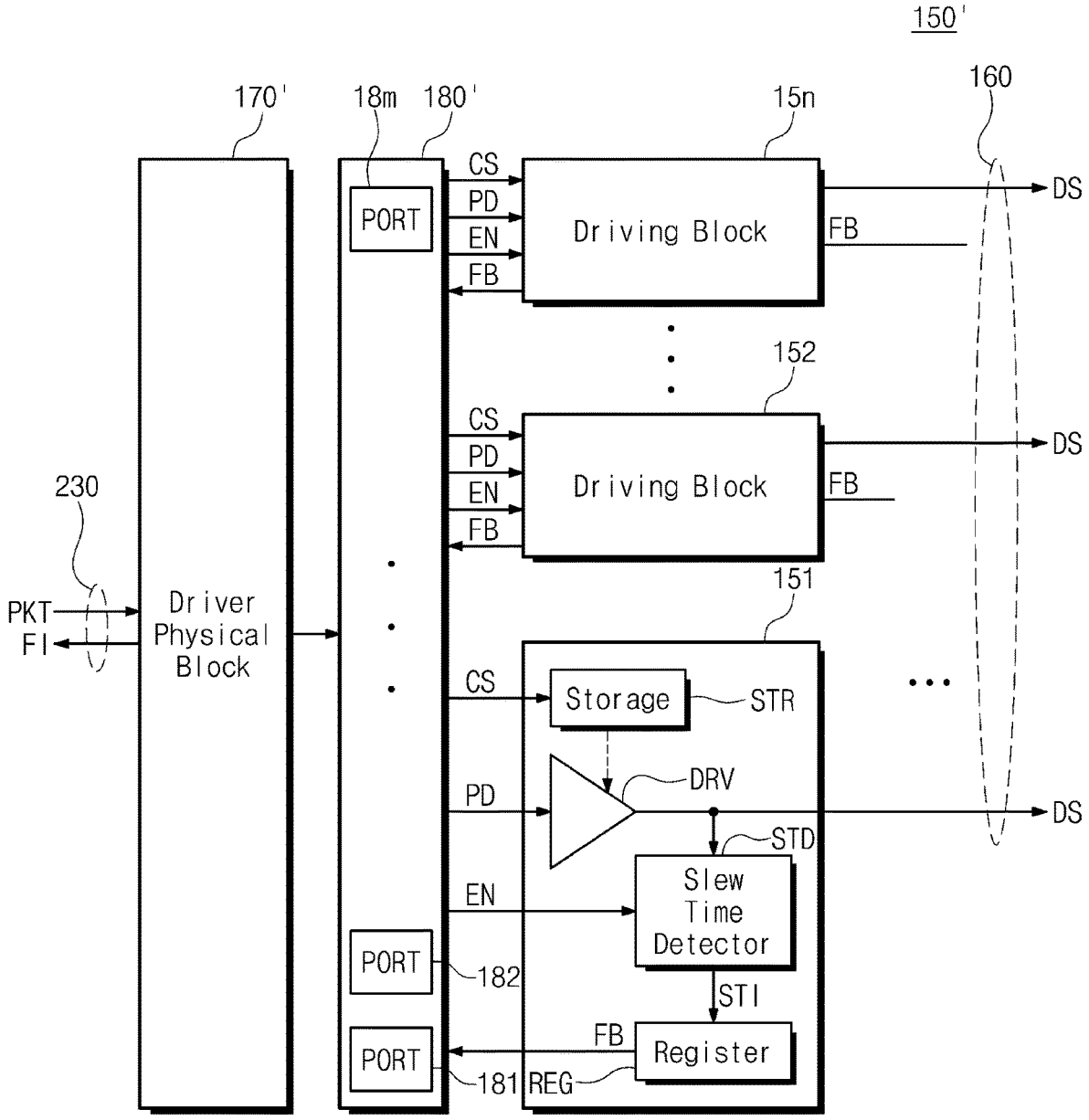
FIG. 13 is a block diagram illustrating a source driver according to another example embodiment of the inventive concepts.

FIG. 13 is a block diagram illustrating a source driver 150' according to another example embodiment of the inventive concepts. Referring to FIG. 13, a source driver 150' includes the first to n-th driving blocks 151 to 15*n*, a driver physical block 170', and the port unit 180', but is not limited thereto. Compared with the source driver 150 of FIG. 2, the source driver 150' includes a single driver physical block 170'.

The first to n-th driving blocks 151 to 15*n* may transfer the feedback signal FB to the port unit 180'. The port unit 180' may packetize the feedback signal FB to the feedback information FI and may transfer the feedback information FI to the driver physical block 170'. The driver physical block 170' may transfer the feedback information FI to the timing controller 300.

Figure 14:
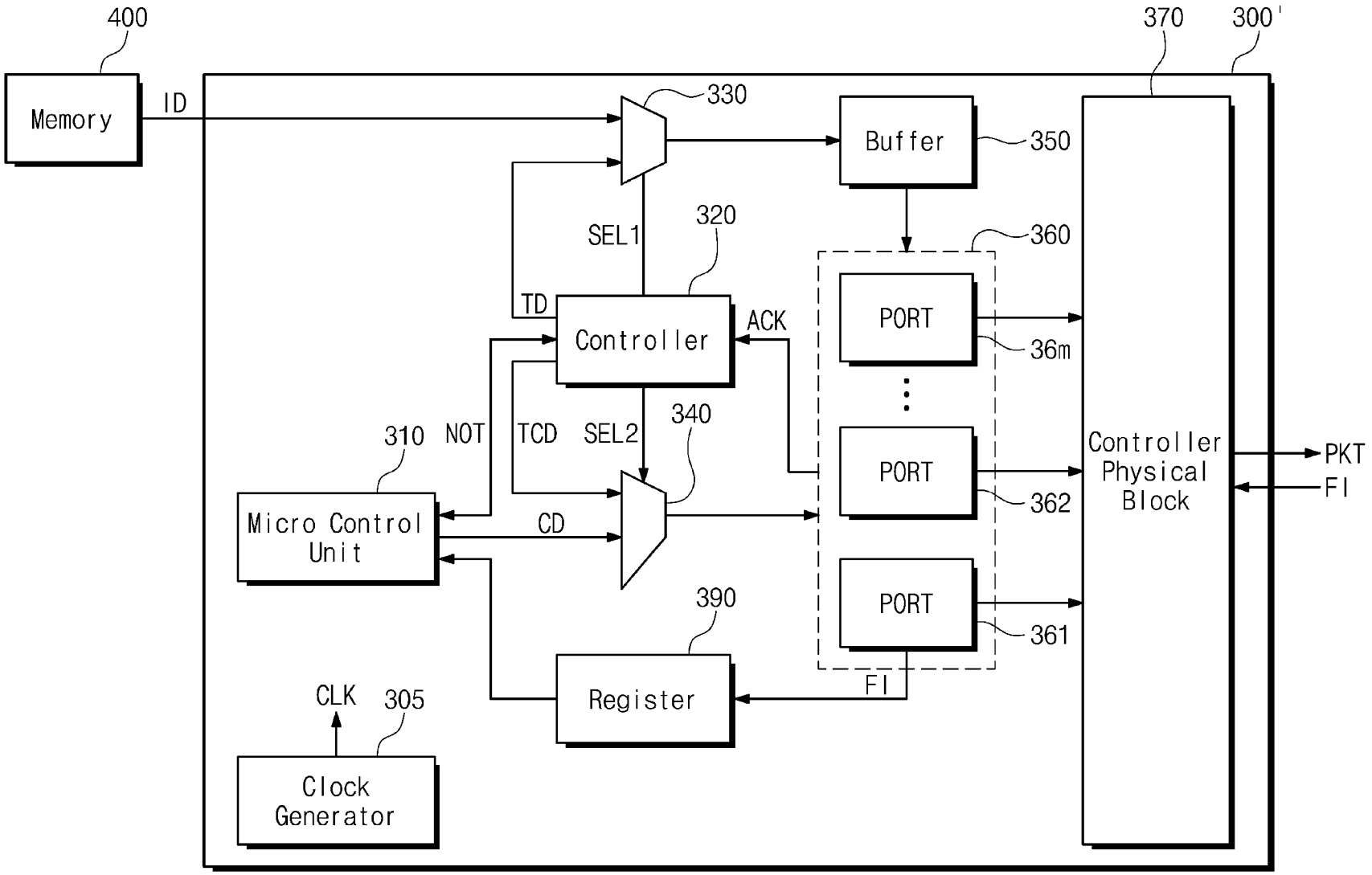
FIG. 14 is a block diagram illustrating the timing controller according to another example embodiment of the inventive concepts.

FIG. 14 is a block diagram illustrating a timing controller 300' according to another example embodiment of the inventive concepts. Referring to FIG. 14, the timing controller 300' includes the clock generator 305, the micro control unit 310, the controller 320, the first multiplexer 330, the second multiplexer 340, the buffer 350, a port unit 360', a controller physical block 370, and the register 390, etc.

Compared with the timing controller 300 of FIG. 3, no receiver 380 may be provided in the timing controller 300'. Also, the timing controller 300' includes a single controller physical block 370. The port unit 360' may receive the feedback information FI as a packet. The port unit 360' may store the feedback information FI in the register 390 and may transmit an acknowledge signal ACK to the controller 320.

Referring to FIGS. 13 and 14, the feedback information FI may be transferred through a main channel, not a sideband channel between the timing controller 300' and the source driver 150'. The controller physical block 370, the driver physical block 170', and the port units 360' and 180' may be configured to perform bidirectional communication.

Figure 15:
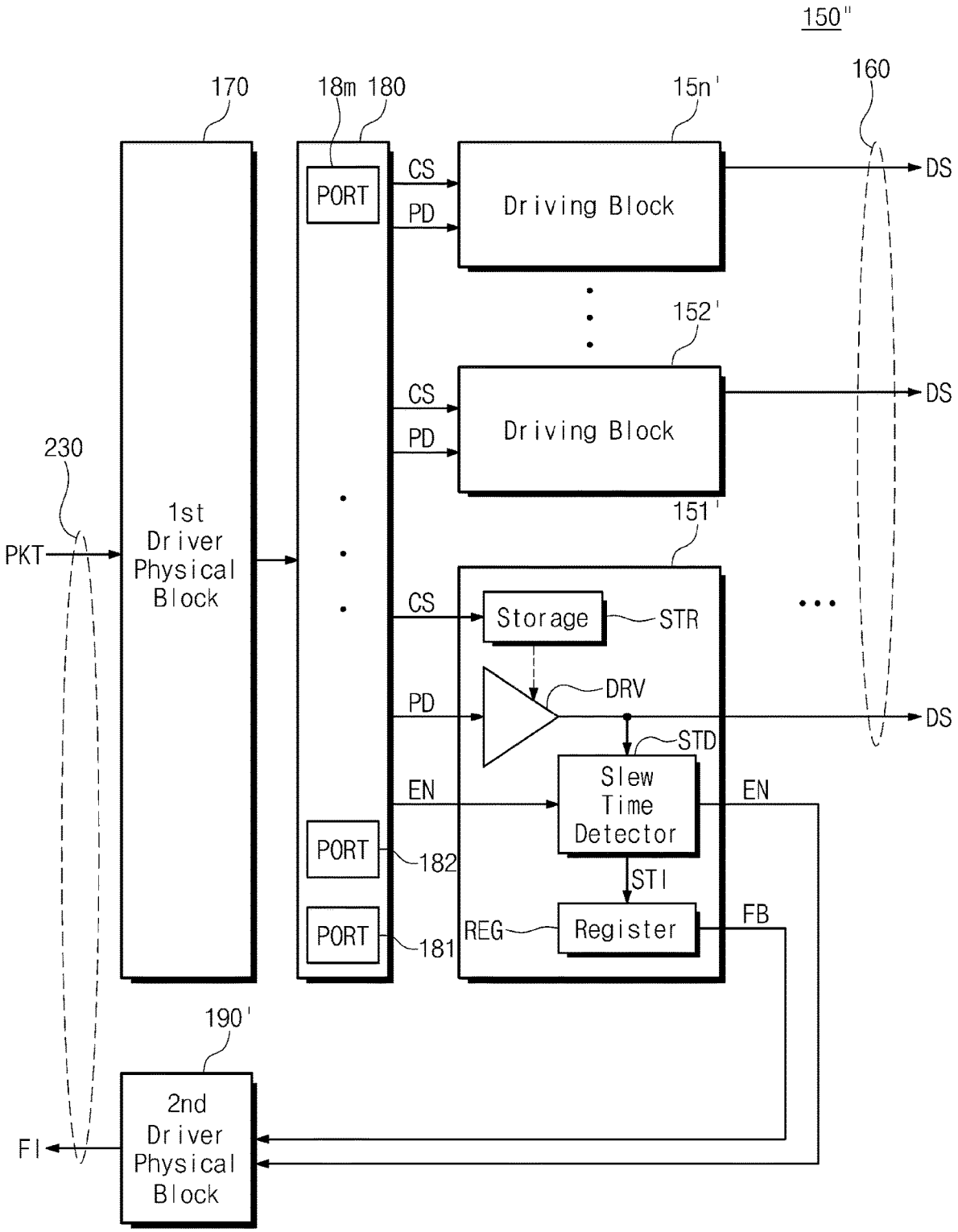
FIG. 15 is a block diagram illustrating the source driver according to another example embodiment of the inventive concepts.

FIG. 15 is a block diagram illustrating a source driver 150" according to another example embodiment of the inventive concepts. Referring to FIGS. 1 and 15, the source driver 150" includes first to n-th driving blocks 151' to 15*n'*, the first driver physical block 170, the port unit 180, and a second driver physical block 190', etc. Compared with the source driver 150 of FIG. 2, the slew time detector STD and the register REG may be provided in only some of the first to n-th driving blocks 151' to 15*n'*.

At least one example embodiment is illustrated in FIG. 15 as the first driving block 151' includes the slew time detector STD and the register REG. However, the example embodiments may not be limited thereto. For example, the number of driving blocks, each of which includes the slew time detector STD and the register REG, is not limited. A structure of each of the remaining second to n-th driving blocks 152' to 15*n'* may be different from that of the first driving block 151'. The slew time detector STD and the register REG may not be provided in the second to n-th driving blocks 152' to 15*n'*.

Since the slew time detector STD and the register REG are not provided in the second to n-th driving blocks 152' to 15*n'*, the enable signal EN may not be supplied to the second to n-th driving blocks 152' to 15*n'*. Since the register REG is not provided in the second to n-th driving blocks 152' to 15*n'*, the feedback signal FB may not be output from the second to n-th driving blocks 152' to 15*n'*.

A slew time of the first driving block 151' may be detected as a sample among the first to n-th driving blocks 151' to 15*n'*. The timing controller 300 may update ways for all of the first to n-th driving blocks 151' to 15*n'* to drive voltages of the source lines 160 by using a slew time of the first driving block 151'.

In at least one example embodiment, as described with reference to FIG. 13, the feedback signal FB of the first driving block 151 may be output to the timing controller 300 through the port unit 180 and the first driver physical block 170, not through the second driver physical block 190'. The first driver physical block 170 and the port unit 180 may be configured to perform bidirectional communication.

Figure 16:
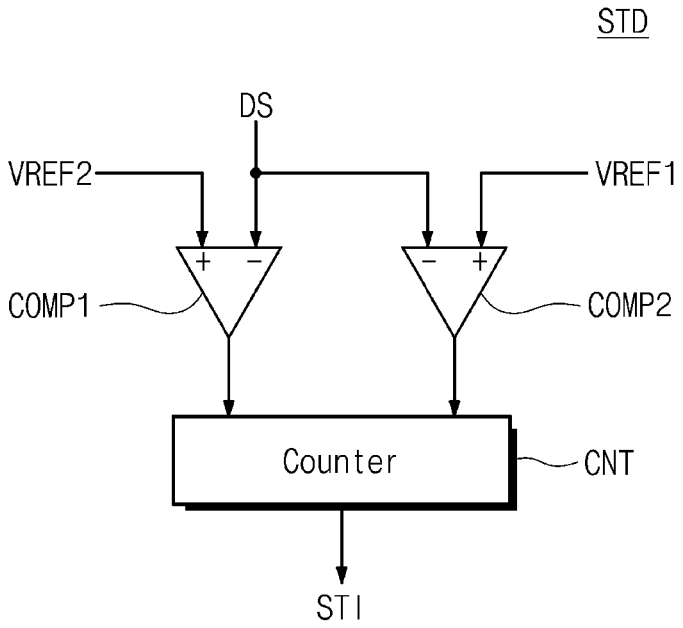
FIG. 16 illustrates an example of a slew time detector according to at least one example embodiment of the inventive concepts.

FIG. 16 illustrates an example of the slew time detector STD according to at least one example embodiment. Referring to FIGS. 12 and 16, the slew time detector STD includes a first comparator COMP1, a second comparator COMP2, and a counter CNT, but is not limited thereto. The first comparator COMP1 may compare a first reference voltage VREF1 and the driving signal DS.

For example, the first reference voltage VREF1 may be 0.1 VM corresponding to 10% of the maximum value VM. If the driving signal DS reaches 0.1 VM, the first comparator COMP1 may allow an output signal to transition from a high level (e.g., a positive voltage) to a low level (e.g., a negative voltage).

The second comparator COMP2 may compare a second reference voltage VREF2 and the driving signal DS. For example, the second reference voltage VREF2 may be 0.9 VM corresponding to 90% of the maximum value VM. If the driving signal DS reaches 0.9 VM, the second comparator COMP2 may allow an output signal to transition from a high level (e.g., a positive voltage) to a low level (e.g., a negative voltage).

The counter CNT may start to count when the output of the first comparator COMP1 transitions from the high level to the low level. The counter CNT may perform counting when the output of the second comparator COMP2 transitions from the high level to the low level. The counter CNT may output the counted value as slew time information STI.

Figure 17:
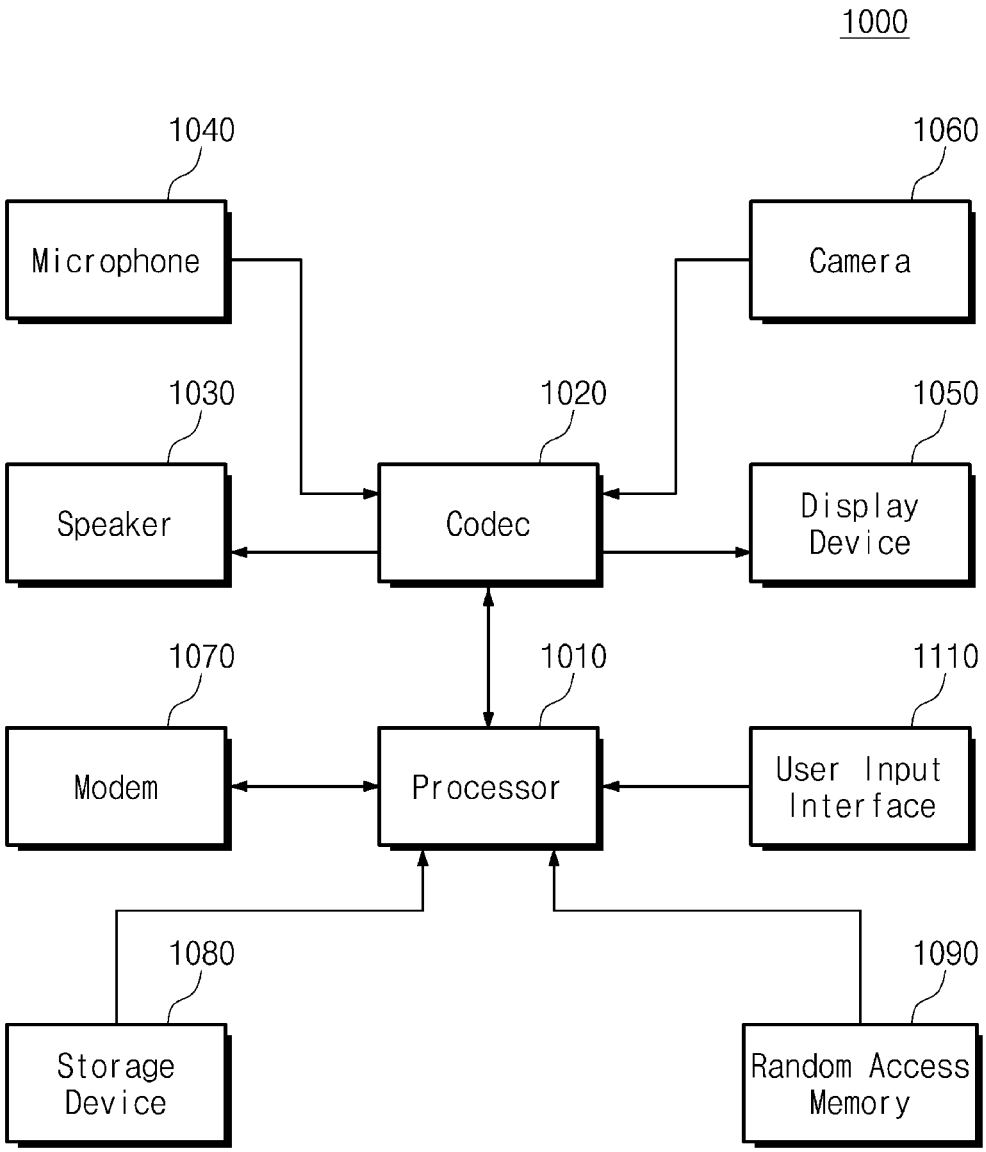
FIG. 17 is a block diagram illustrating a multimedia device according to at example embodiment of the inventive concepts.

FIG. 17 is a block diagram illustrating a multimedia device 1000 according to at least one example embodiment of the inventive concepts. Referring to FIG. 17, the multimedia device 1000 includes a processor 1010, a codec 1020, a speaker 1030, a microphone 1040, a display device 1050, a camera 1060, a modem 1070, a storage device 1080, a random access memory 1090, and a user input interface 1100, etc., but is not limited thereto.

The application processor 1010 may drive an operating system for operating the multimedia device 1000 and may drive various applications on the operating system. The codec 1020 may perform coding and decoding on a voice signal or an image signal. The codec 1020 may be entrusted with and perform a task associated with processing a voice signal or an image signal from the processor 1010.

The speaker 1030 may play a voice signal transferred from the codec 1020. The microphone 1040 may detects sound from the outside, may convert the detected sound into an electrical voice signal, and may output the voice signal to the codec 1020. The display device 1050 may play an image signal transferred from the codec 1020.

The display device 1050 may include the display device 100 described with reference to FIGS. 1 to 16. For example, the timing controller 300 (refer to FIG. 1) of the display device 1050 may control the source drivers 150 to allow the source drivers 150 to detect a slew time and to report the detected slew time. The timing controller 300 may update ways for the source drivers 150 to control voltages of the source lines 160 by using the obtained slew time.

A display driving device (e.g., the timing controller 300 and the source drivers 150) of the display device 1050 may automatically compensate for differences between charging rates of the source drivers 150. Accordingly, it is possible to reduce and/or prevent a decrease in an image quality such as block dim due to differences between charging rates of the source drivers 150 in the display device 1050. This means that the quality of the multimedia device 1000 including the display device 1050 is improved.

The camera 1060 may convert a scene in a field of vision into an electrical image signal and may output the image signal to the codec 1020. The modem 1070 may communicate with an external device using a wired communication protocol or wirelessly. The modem 1070 may transfer data to an external device in response to a request of the processor 1010 or may request data from the external device.

The storage device 1080 may be main storage of the multimedia device 1000. The storage device 1080 may be used to store data for a long time and may retain data stored therein even though power is removed. The random access memory 1090 may be used as a main memory of the multimedia device 1000. The random access memory 1090 may be used for masters (e.g., the processor 1010, the modem 1070, the codec 1020, etc.) to temporarily store data.

The user input interface 1100 may include various devices that receive inputs from a user. For example, the user input interface 1100 may include devices, which receive an input directly from the user, such that a touch panel, a touch screen, a button, a key pad, and a remote controller, or devices, which indirectly receive results generated by actions of the user, such as an optical sensor, a proximity sensor, a gyroscope sensor, a pressure sensor, and a motion detection sensor.

A display driving device according to at least one example embodiment of the inventive concepts detects slew times of source drivers and updates the source drivers depending on the detected slew times, respectively. Accordingly, it is possible to compensate for differences between charging rates in source drivers and to reduce and/or prevent a decrease in an image quality due to the difference between the charging rates.

It should be understood that example embodiments described herein should be considered in a descriptive sense only and not for purposes of limitation. Descriptions of features or aspects within each device or method according to example embodiments should typically be considered as available for other similar features or aspects in other devices or methods according to example embodiments. While some example embodiments have been particularly shown and described, it will be understood by one of ordinary skill in the art that variations in form and detail may be made therein without departing from the spirit and scope of the claims.

As is traditional in the field of the inventive concepts, various example embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, and the like, which may be formed using semiconductor-based fabrication techniques or other manufacturing technologies. In the case of the blocks, units and/or modules being implemented by microprocessors or similar processing devices, they may be programmed using software (e.g., microcode) to perform various functions discussed herein and may optionally be driven by firmware and/or software, thereby transforming the microprocessor or similar processing devices into a special purpose processor. Additionally, each block, unit and/or module may be implemented by dedicated hardware, or as a combination of dedicated hardware to perform some functions and a processor (e.g., one or more programmed microprocessors and associated circuitry) to perform other functions. Also, each block, unit and/or module of the embodiments may be physically separated into two or more interacting and discrete blocks, units and/or modules without departing from the scope of the inventive concepts. Further, the blocks, units and/or modules of the embodiments may be physically combined into more complex blocks, units and/or modules without departing from the scope of the inventive concepts.

What is claimed is:

1. A display driving device comprising:

a source driver configured to, receive information of voltage levels to be displayed on a pixel array, supply voltages to a plurality of source lines connected to the pixel array based on the information of the voltage levels, detect a first slew time of at least one first voltage of at least one first source line among the source lines by measuring an amount of time for the at least one first voltage to reach a corresponding target level indicated by the information of the voltage levels, and output the first slew time; and a timing controller configured to receive the first slew time from the source driver and to transmit update information for the source driver to control the voltages based on the first slew time, wherein the source driver includes, a first driver physical block configured to receive the information and a detection request of the first slew time from the timing controller;

a second driver physical block configured to output the first slew time to the timing controller; and a plurality of driving blocks respectively connected to the source lines and configured to drive the voltages respectively based on the information, the plurality of driving blocks including at least one first driving block, the at least one first driving block including a first slew time detector configured to detect the first slew time, and wherein each of the plurality of driving blocks further includes a block driver, and a storage device configured to store corresponding update information among the update information related to timing information when the block driver controls the voltage, or a target slew time when the block driver controls the voltage.

2. The display driving device of claim 1, wherein the timing controller is configured to:

detect the first slew time in a first mode; and update timings of the source driver to adjust the at least one first voltage in a second mode.

3. The display driving device of claim 1, wherein each of the block drivers included in the plurality of driving blocks are configured to:

control a voltage of a corresponding source line based on corresponding information among the information of the voltages; and control the voltage based on the corresponding update information stored in the storage device.

4. The display driving device of claim 1, wherein the plurality of driving blocks includes at least one second driving block, the at least one second driving block including a second slew time detector configured to detect a second slew time;

the source driver is configured to output the second slew time along with the first slew time to the timing controller through the second driver physical block; and the timing controller is configured to generate the update information by using a result of computing the first slew time and the second slew time.

5. The display driving device of claim 1, wherein the source driver is configured to:

receive a detection request of the first slew time through a first channel; and detect the first slew time in response to the detection request.

6. The display driving device of claim 5, wherein the source driver is configured to:

adjust the voltages from a positive minimum value to a positive maximum value based on the voltage information when measuring the amount of time.

7. The display driving device of claim 5, wherein the source driver is configured to output the first slew time to the timing controller through a second channel different from the first channel.

8. The display driving device of claim 5, wherein the timing controller is configured to transmit the update information to control the at least one first voltage through the first channel.

9. The display driving device of claim 1, wherein the timing controller includes:

a micro control unit configured to output first configuration information including the update information;

one or more ports configured to output the information of the voltages through a first controller physical block; and a controller configured to transfer first image data from an external device and the first configuration information from the micro control unit to the one or more ports in a normal mode, and to transfer second test image data and second test configuration information to the one or more ports in a compensation mode.

10. The display driving device of claim 9, wherein the timing controller further includes a receiver configured to receive the first slew time from the source driver through a second controller physical block in the compensation mode; and the micro control unit is configured to update the update information of the first configuration information based on the first slew time.

11. A display driving device comprising:

a plurality of source drivers configured to receive information of voltage levels to be displayed on a pixel array, supply voltages to a plurality of source lines connected to the pixel array, detect slew times of at least a part of the source lines by measuring amount of times for the at least a part of the voltages to reach corresponding target levels indicated by the information, and to output the slew times; and a timing controller configured to receive the slew times from the plurality of source drivers and to transmit update information to the plurality of source drivers based on the slew times so that the plurality of source drivers uniformly control the voltages, wherein the timing controller includes, a micro control unit configured to output first configuration information including the update information;

one or more ports configured to output the information through a first controller physical block;

a receiver configured to receive the slew times from the plurality of source drivers through a second controller physical block; and the micro control unit is configured to update the update information of the first configuration information based on the slew times.

12. The display driving device of claim 11, wherein when the voltages of the plurality of source drivers change from a positive minimum value to a positive maximum value, the timing controller is configured to update the plurality of source drivers so that points in time when the voltages reaches 90% of the maximum value are uniform.

13. The display driving device of claim 11, wherein the timing controller is configured to update one or more of timings associated with one or more of the plurality of source drivers when the one or more of the source drivers start to control the voltages based on the slew times by updating the update information.

14. The display driving device of claim 11, wherein when the plurality of source drivers supply the voltages to the source lines in connection with partial pixels of a blank area of the pixel array, the timing controller is configured to control the plurality of source drivers so as to detect the slew times.

15. The display driving device of claim 11, wherein the timing controller is configured to:

control the plurality of source drivers to detect the slew times after a boot-up operation; and update the plurality of source drivers based on the detected slew times by updating the update information.

16. The display driving device of claim 11, wherein the timing controller is configured to:

control the plurality of source drivers based on a request of an external device to detect the slew times; and update the source drivers based on the slew times by updating the update information.

17. The display driving device of claim 11, wherein the timing controller is configured to:

control the plurality of source drivers to periodically detect the slew times; and update the plurality of source drivers based on the slew times by updating the update information.

18. An operating method of a display driving device which includes a plurality of source drivers and a timing controller, the method comprising:

receiving information of voltage levels to be displayed on a pixel array;

supplying voltages to a plurality of source lines connected to the pixel array based on the information of the voltage levels;

measuring amounts of times for at least a part of the voltages to reach corresponding target levels indicated by the information to detect slew times for the plurality of source drivers to control the voltages of the plurality of source lines depending on a request of the timing controller; and updating, by the timing controller, the plurality of source drivers based on the slew times so that the plurality of source drivers controls the voltages uniformly; wherein the plurality of source drivers includes at least a first driving block and second driving block, the first driving block including a first slew time detector, and the second driving block including a second slew time detector, and the method further comprises, detecting, using the first slew time detector, a first slew time;

detecting, using the second slew time detector, a second slew time;

outputting the second slew time along with the first slew time to the timing controller; and generating, by the timing controller, update information based on the first slew time and the second slew time, wherein the timing controller includes outputting, by the timing controller, first configuration information including the update information; and outputting, by the timing controller, the first configuration information through a first controller physical block and receiving the slew times from the plurality of source drivers through a second controller physical block.

19. The method of claim 18, further comprising:

transferring, by the timing controller, image data to the plurality of source drivers to control the voltages based on results of the updating; and controlling, by the plurality of source drivers, the voltages based on the image data to display the image data.

20. A display driving device comprising:

a source driver configured to, receive information of voltage levels to be displayed on a pixel array, supply voltages to a plurality of source lines connected to the pixel array based on the information of the voltage levels, detect a first slew time of at least one first voltage of at least one first source line among the source lines by measuring an amount of time for the at least one first voltage to reach corresponding target level indicated by the information of the voltage levels, and output the first slew time; and a timing controller configured to receive the first slew time from the source driver and to transmit update information for the source driver to control the voltages based on the first slew time, wherein the timing controller includes, a micro control unit configured to output first configuration information including the update information;

one or more ports configured to output the information through a first controller physical block; and a controller configured to transfer first image data from an external device and the first configuration information from the micro control unit to the one or more ports in a normal mode, and to transfer second test image data and second test configuration information to the one or more ports in a compensation mode;

a receiver configured to receive the first slew time from the source driver through a second controller physical block in the compensation mode; and the micro control unit is configured to update the update information of the first configuration information based on the first slew time.

* * * * *